US008851926B2

(12) United States Patent
Lange et al.

(10) Patent No.: US 8,851,926 B2
(45) Date of Patent: Oct. 7, 2014

(54) LOW-CROSS-TALK ELECTRICAL CONNECTOR

(75) Inventors: Ludwig Lange, Nuland (NL); Paul Potters, Eindhoven (NL); Thierry Goossens, Herdersem-Aalst (BE); Winnie Heyvaert, Wuustwezel (BE)

(73) Assignee: FCI, Guyanourt (FR)

( * ) Notice: Subject to any disclaimer, the term of this patent is extended or adjusted under 35 U.S.C. 154(b) by 100 days.

(21) Appl. No.: 13/376,027

(22) PCT Filed: Jun. 3, 2010

(86) PCT No.: PCT/IB2010/001939

§ 371 (c)(1),
(2), (4) Date: Feb. 13, 2012

(87) PCT Pub. No.: WO2010/140064

PCT Pub. Date: Dec. 9, 2010

(65) Prior Publication Data

US 2012/0135643 A1 May 31, 2012

Related U.S. Application Data

(60) Provisional application No. 61/184,268, filed on Jun. 4, 2009.

(51) Int. Cl.

| | |
|---|---|
| ***H01R 13/648*** | (2006.01) |
| ***H01R 13/6471*** | (2011.01) |
| ***H01R 13/6586*** | (2011.01) |
| ***H01R 13/6477*** | (2011.01) |
| *H01R 13/6587* | (2011.01) |

(52) U.S. Cl.

CPC ..... *H01R 13/6471* (2013.01); *H01R 13/6586* (2013.01); *H01R 13/6587* (2013.01); *H01R 13/6477* (2013.01)

USPC ..... 439/607.07

(58) Field of Classification Search

CPC ... H01R 13/514; H01R 23/688; H01R 23/005

USPC ..... 439/607.07, 941, 701

See application file for complete search history.

(56) References Cited

U.S. PATENT DOCUMENTS 595,191 A 12/1897 Miller et al.
4,846,727 A * 7/1989 Glover et al. ..... 439/607.07

(Continued)

FOREIGN PATENT DOCUMENTS

JP 11-067369 3/1999
WO WO 01/57963 A2 8/2001

OTHER PUBLICATIONS

Amleshi, P. et al.; "Interconnect Design Optimization and Characterization for Advanced High Speed Backplane Channel Links"; DesignCon 2009; whole document (38 pages).

*Primary Examiner* — Phuong Dinh

(74) *Attorney, Agent, or Firm* — Harrington & Smith

(57) ABSTRACT

An electrical connector includes a first contact module and a second contact module adjacent the first contact module. Each contact module has a plurality of ground and signal contacts. Each ground contact and signal contact includes a mating portion, a mounting portion, and an intermediate portion extending between the mating portion and the mounting portion. In each contact module, the intermediate portions of the ground contacts are disposed in a first common plane and the intermediate portions of the signal contacts are disposed in a second common plane that is spaced from the first common plane. The first contact modules and the second contact modules are arranged such that two adjacent signal contacts of the first and second contact modules, respectively, define a differential signal pair such that the intermediate portions of the adjacent signal contacts are spaced more closely than the intermediate portions of two adjacent ground contacts of the first and second contact modules, respectively.

14 Claims, 21 Drawing Sheets

(56) References Cited

U.S. PATENT DOCUMENTS

| | | | | |
|---|---|---|---|---|
| 5,795,191 | A | 8/1998 | Preputnick et al. | 439/608 |
| 5,993,259 | A | 11/1999 | Stokoe et al. | 439/608 |
| 6,503,103 | B1 | 1/2003 | Cohen et al. | 439/608 |
| 6,692,272 | B2 | 2/2004 | Lemke et al. | 439/108 |
| 7,320,621 | B2 | 1/2008 | Laurx et al. | 439/608 |
| 7,798,852 | B2 * | 9/2010 | Laurx et al. | 439/607.08 |
| 8,021,170 | B2 * | 9/2011 | Pan | 439/108 |
| 8,460,023 | B2 * | 6/2013 | Someya | 439/275 |
| 2007/0099507 | A1 | 5/2007 | Ohnishi et al. | 439/608 |
| 2007/0205774 | A1 | 9/2007 | Minich | 324/538 |
| 2008/0318455 | A1 | 12/2008 | Beaman et al. | 439/108 |
| 2011/0256763 | A1 * | 10/2011 | De Geest et al. | 439/607.01 |

* cited by examiner

LOW-CROSS-TALK ELECTRICAL CONNECTOR

CROSS-REFERENCE TO RELATED APPLICATIONS

This application claims the benefit of U.S. provisional patent application Ser. No. 61/184,268 filed on Jun. 4, 2009, the disclosure of which is hereby incorporated by reference as if set forth in its entirety herein.

TECHNICAL FIELD

The present disclosure relates generally to the field of electrical connectors, and in particular relates to an electrical connector that is configured to reduce cross-talk between adjacent signal contacts.

BACKGROUND

Electrical connectors provide signal connections between electronic devices using electrically-conductive contacts, or electrical contacts. In some applications, an electrical connector provides a connectable interface between one or more substrates, e.g., printed circuit boards. Such an electrical connector may include a receptacle connector mounted to a first substrate and a complementary header connector mounted to a second substrate. Typically, a first plurality of electrical receptacle contacts in the receptacle connector is adapted to mate with a corresponding plurality of electrical header contacts in the header connector. For instance, the electrical receptacle contacts can receive the electrical header contacts so as to establish an electrical connection between the electrical receptacle contacts and the electrical header contacts.

The electrical contacts typically include a plurality of signal contacts and ground contacts. Often, the signal contacts are so closely spaced that undesirable interference, or "cross talk," occurs between adjacent signal contacts. As used herein, the term "adjacent" refers to contacts (or rows or columns) that are next to one another. Cross talk occurs when one signal contact induces electrical interference in an adjacent signal contact due to intermingling electrical fields, thereby compromising signal integrity. With electronic device miniaturization and high speed, high signal integrity electronic communications becoming more prevalent, the reduction of cross talk becomes a significant factor in connector design.

One commonly used technique for reducing cross talk is to position separate electrical shields, in the form of metallic plates, for example, between adjacent signal contacts. The shields act to block cross talk between the signal contacts by blocking the intermingling of the contacts' electric fields. The ground contacts are also frequently used to block cross talk between adjacent differential signal pairs.

Because of the demand for smaller, lower weight communications equipment, it is desirable that connectors be made smaller and lower in weight, while providing the same performance characteristics. Shields take up valuable space within the connector that could otherwise be used to provide additional signal contacts, and thus limit contact density (and, therefore, connector size). Additionally, manufacturing and inserting such shields substantially increase the overall costs associated with manufacturing such connectors. In some applications, shields are known to make up 40% or more of the cost of the connector. Another known disadvantage of shields is that they lower impedance. Thus, to make the impedance high enough in a high contact density connector, the contacts would need to be so small that they would not be robust enough for many applications.

It is desirable to provide an electrical connector that occupies a minimum amount of substrate space while reducing the occurrence of cross talk between the signal contacts of the electrical connector.

SUMMARY

In accordance with one embodiment, an electrical connector includes a first contact module and a second contact module adjacent the first contact module. Each contact module has a plurality of ground and signal contacts. Each ground contact and signal contact includes a mating portion, a mounting portion, and an intermediate portion extending between the mating portion and the mounting portion. In each contact module, the intermediate portions of the ground contacts are disposed in a first common plane and the intermediate portions of the signal contacts are disposed in a second common plane that is spaced from the first common plane. The first contact modules and the second contact modules are arranged such that two adjacent signal contacts of the first and second contact modules, respectively, define a differential signal pair such that the intermediate portions of the adjacent signal contacts are spaced more closely than the intermediate portions of two adjacent ground contacts of the first and second contact modules, respectively.

DETAILED DESCRIPTION

Figure 1A:
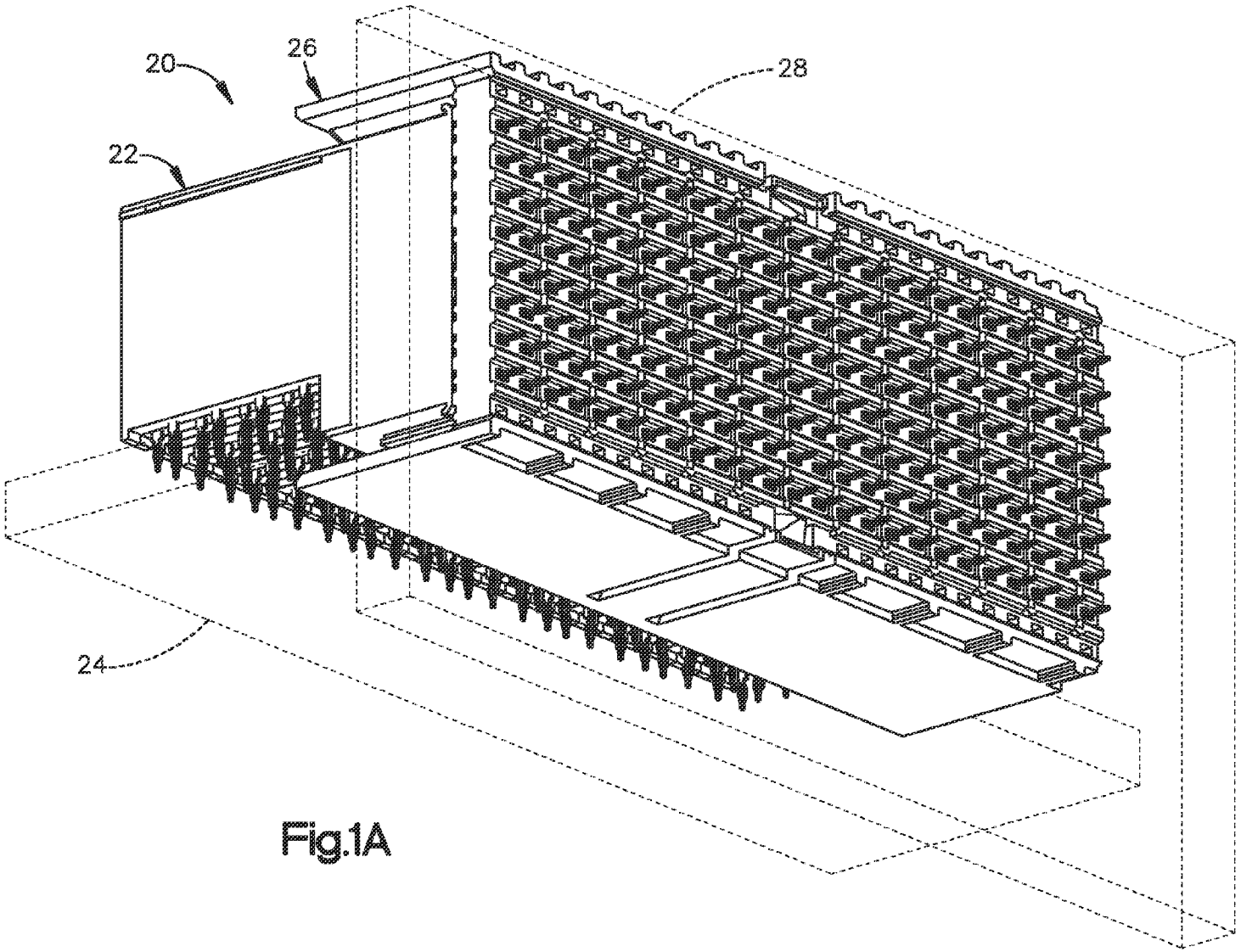
FIG. 1A is a perspective view of an electrical connector system constructed in accordance with one embodiment including a first electrical connector and a second electrical connector configured to be electrically connected to first and second respective substrates.

Referring to FIG. 1A, an electrical connector system 20 includes a first electrical connector 22 configured to be electrically connected to a first substrate 24 which can be provided as a printed circuit board (PCB), and a second electrical connector 26 configured to be electrically connected to a second substrate 28 such as a PCB. The first and second electrical connectors 22 and 26 are configured to mate with each other so as to place the first and second substrates 22 and 26 in electrical communication with each other.

Figure 1B:
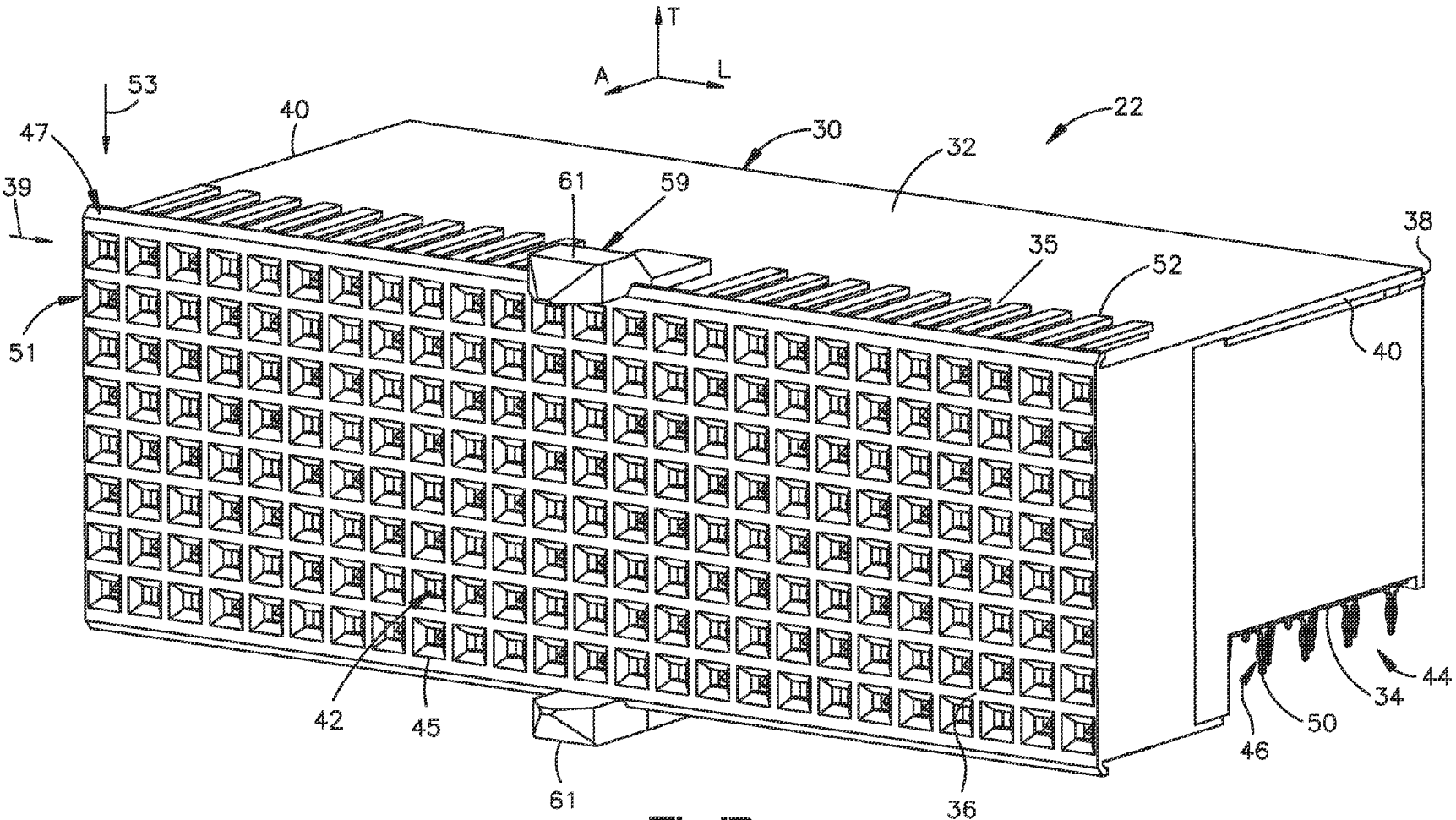
FIG. 1B is a perspective view of the first electrical connector illustrated in FIG. 1A, including a connector housing and a plurality of electrical contacts supported by the connector housing.

Referring also to FIG. 1B, the first electrical connector 22 includes a connector housing 30 that is dielectric or electrically insulative, and defines a top end 32, an opposing bottom end 34, a front end 36, an opposing rear end 38, and opposing sides 40. The opposed sides 40 are spaced apart along a longitudinal direction L, the front and rear ends 36, 38 are spaced apart along a lateral direction A that is substantially perpendicular with respect to the longitudinal direction L, and the top and bottom ends 32 and 34 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the connector housing 30 may vary during use. In accordance with the illustrated embodiment, the connector housing 30 is illustrated as elongate in the longitudinal direction.

The connector housing 30 defines a mating interface 42 disposed proximate to the front end 36 and a mounting interface 44 disposed proximate to the bottom end 34. The mounting interface 44 is configured to operatively engage the first substrate 24, while the mating interface 42 is configured to operatively engage the second electrical connector 26. The mating interface 42 defines a plurality of aligned receptacle pockets 45 extending through the front end 36. The pockets 45 can be arranged in a plurality of transversely extending columns 47 spaced along a longitudinal common row direction 39, and a plurality of longitudinally extending rows 51 spaced along a transverse common column direction 53. The electrical connector 22 can include as many columns 47 and rows 51 as desired.

Figure 1C:
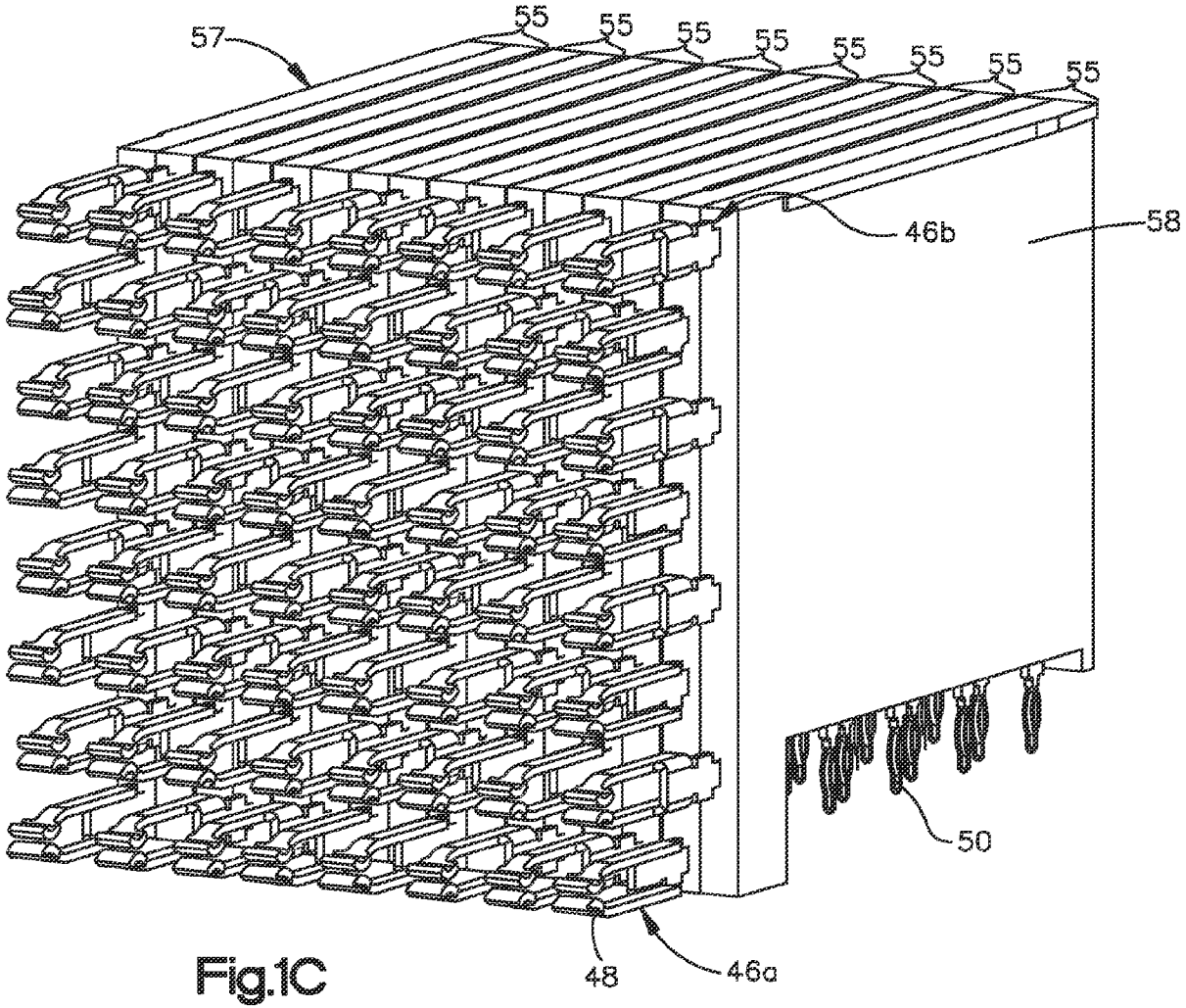
FIG. 1C is a perspective view of a portion of the first electrical connector illustrated in FIG. 1B with the housing removed, showing a plurality of contact modules that retain the electrical contacts.

Referring also to FIG. 1C, the first electrical connector 22 includes a plurality of electrical contacts 46 that are electrically conductive and retained by the connector housing 30. In particular, the electrical connector includes a plurality of contact modules 55 that each includes a plurality of the electrical contacts 46. Each contact module 55 includes a pair of leadframe assemblies 57 that each includes a respective leadframe housing 58, which can be a dielectric or electrically insulative material that retains respective first and second pluralities **46*a* and 46*b* of the electrical contacts 46. The electrical connector 22 can include any number of contact modules 55 as desired. The electrical contacts 46 each define a mating portion 48 disposed proximate to the mating interface 42, and an opposed mounting portion 50 disposed proximate to the mounting interface 44. In particular, the mounting portions 50 of the electrical contacts 46 extend transversely down from the bottom end 34, and the mating portions 48 extend laterally forward to a location rearward of the receptacle pockets 45. Accordingly, each mating portion 48 can be operatively aligned with a corresponding receptacle pocket 45**.

The first electrical connector 20 can define a plurality ribs 52 that extend transversely out from the housing 30 can be longitudinally aligned as illustrated, and grooves 35 that are disposed between adjacent ribs 52. The connector housing 30 can include a guidance member 59 in the form of a pair of forwardly projecting protrusions 61.

Figure 1D:
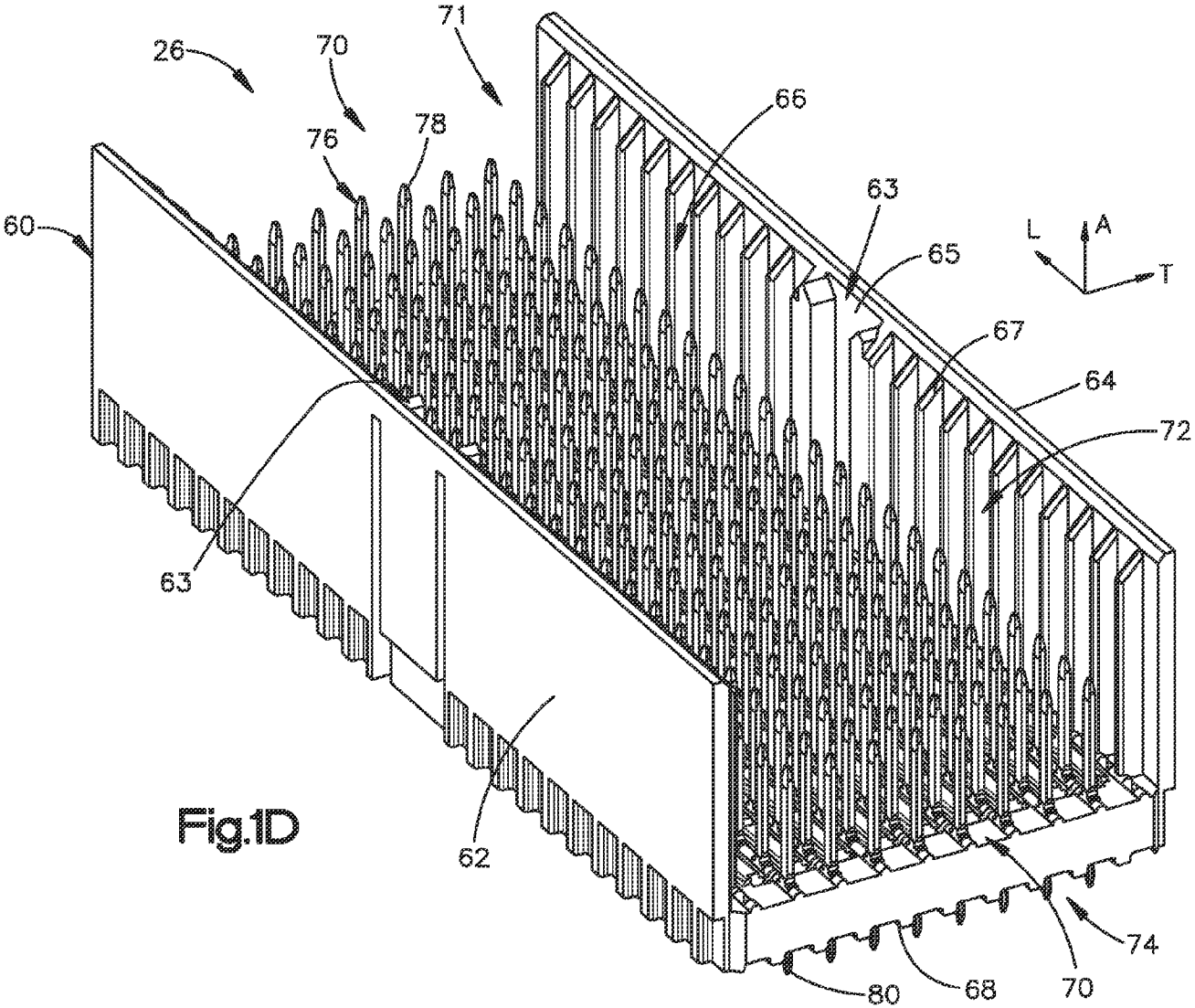
FIG. 1D is a perspective view of the second electrical connector illustrated in FIG. 1A.

Referring now to FIG. 1D, the second electrical connector 26 includes a connector housing 60 that is dielectric or electrically insulative, and defines a top end 62, an opposing bottom end 64, a front end 66, an opposing rear end 68, and opposing sides 70. The opposed sides 70 are spaced apart along the longitudinal direction L, the front end rear ends 66 and 68 are spaced apart along the lateral direction A, and the top and bottom ends 62 and 64 are spaced apart along the transverse direction T.

The connector housing 60 defines a mating interface 72 disposed proximate to the front end 66 and a mounting interface 74 disposed proximate to the rear end 68. In particular, the top and bottom ends 62 and 64 of the connector housing 60 extend forward from the rear end 68, while the front end 66 and opposing sides 70 are open so as to define a pocket 71 at the mating interface 72. The mounting interface 74 is configured to operatively engage the second substrate 28, while the mating interface 72 is configured to operatively engage the first electrical connector 22.

The second electrical connector 22 includes a second plurality of electrical contacts 76 that extend through and are supported by the rear end 68 of the connector housing 60. The electrical contacts 76 each define a mating portion 78 disposed proximate to the mating interface 72, and an opposed mounting portion 80 disposed proximate to the mounting interface 74. In particular, the mounting portions 80 of the second plurality of electrical contacts 76 extend rearward of the rear end 68 of the connector housing 60, and the mating portions 78 extend forward from the rear end 68 of the connector housing 60 and terminate in the pocket 71. The connector housing 60 includes a guidance member 63 in the form of a pair of grooves 65 sized to receive the protrusions 61 of the connector housing 30. Thus, the guidance members 59 and 63 are configured to engage so as to align the electrical connectors 22 and 26 when the connectors 22 and 26 are mated. The connector housing 60 further includes a plurality of ribs 67 that are configured to be received in the grooves 35 that are disposed between the adjacent ribs 52 of the first electrical connector 22.

Figure 1E:
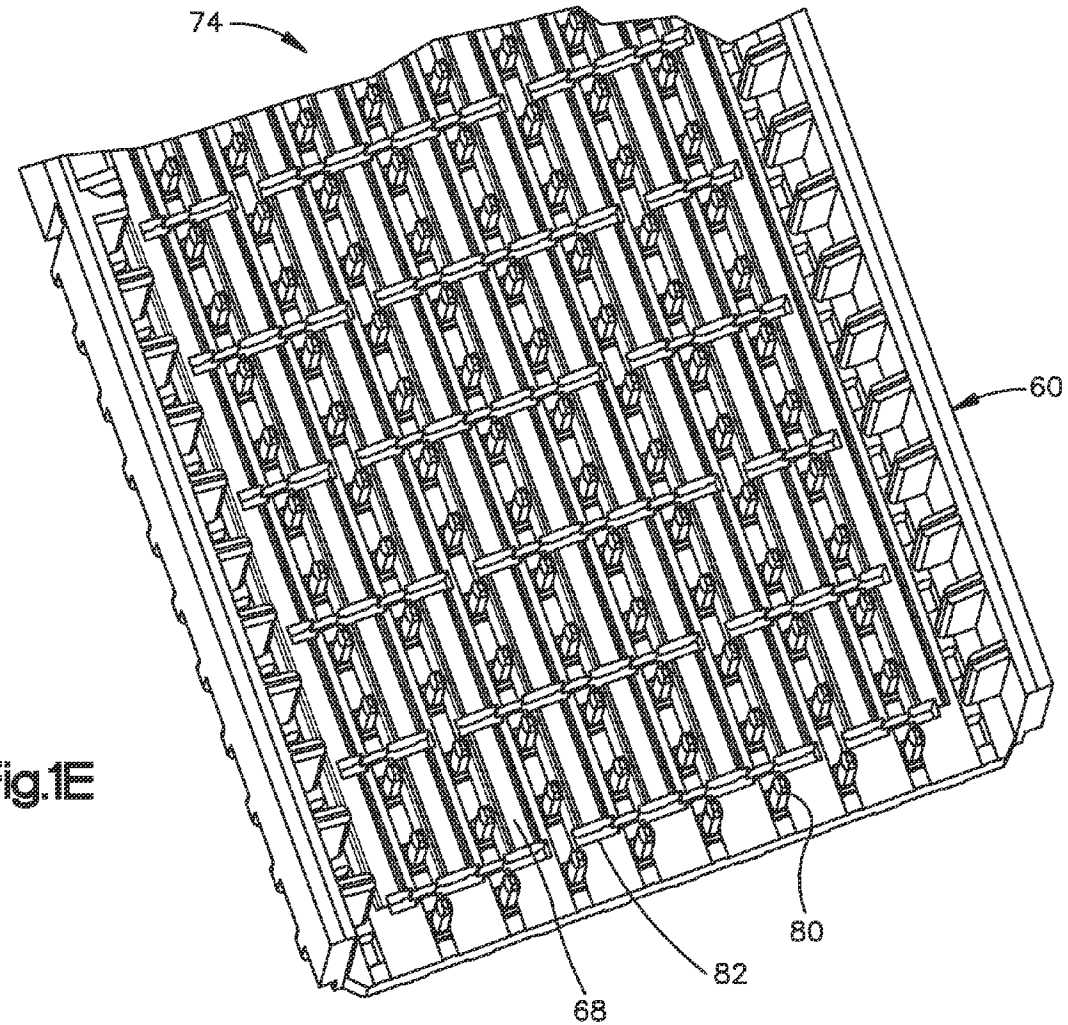
FIG. 1E is another perspective view of the second electrical connector illustrated in FIG. 1A.

As illustrated in FIG. 1E, the connector housing 60 can define a plurality of air passage slots 82 that extend through the rear end 68 proximate to the mounting portions 80 of the electrical contacts 76 so as to allow air to pass through the connector housing 60, which can reduce cross-talk between the electrical contacts during operation.

Figure 1F:
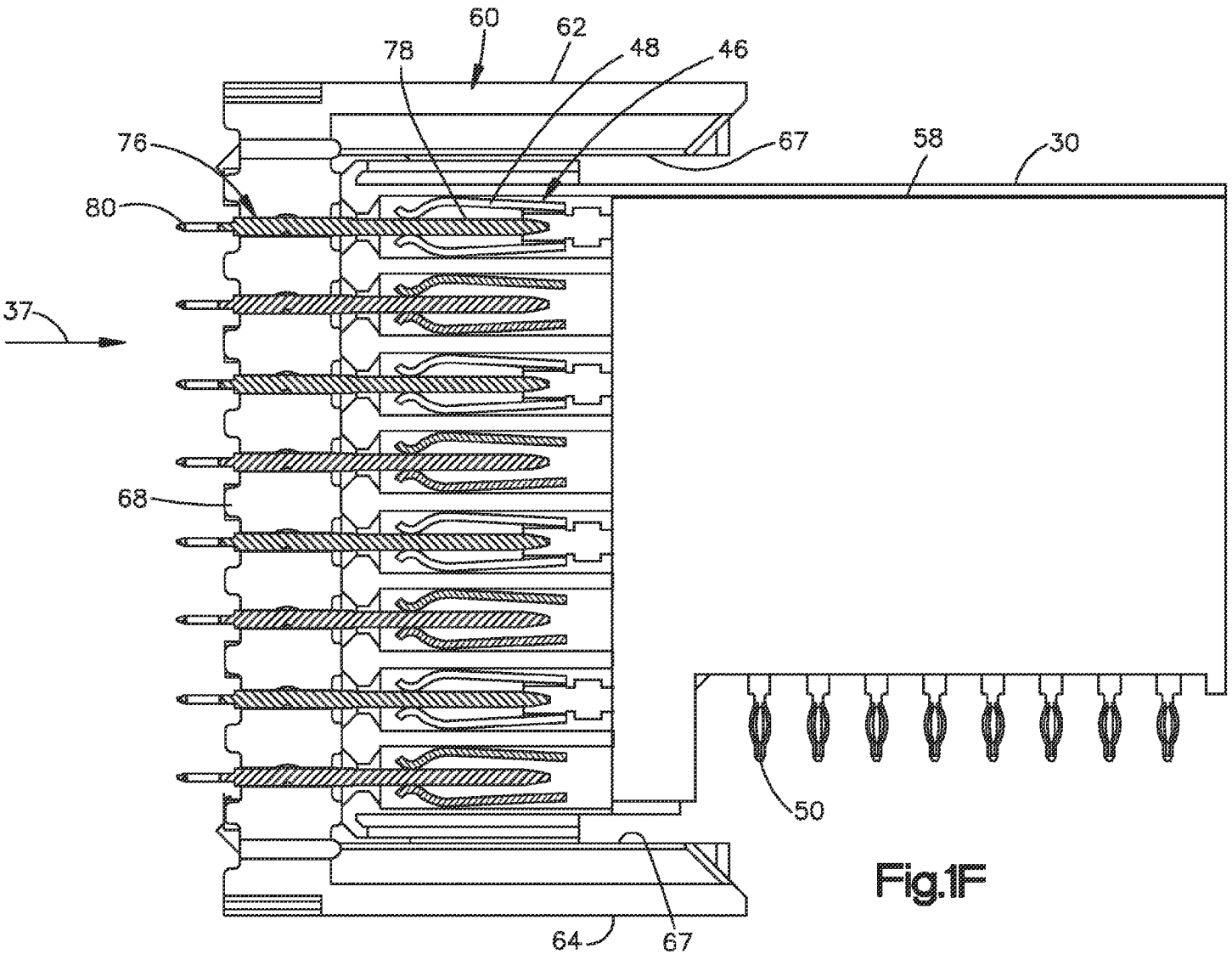
FIG. 1F is a sectional side elevation view of the electrical connector assembly illustrated in FIG. 1A, showing the first electrical connector mated to the second electrical connector.

During operation, the electrical connectors 22 and 26 are configured to be mated to each other such that the mating interface 72 of the second electrical connector 26 mates with the mating interface 42 of the first electrical connector. In accordance with the illustrated embodiment, the front end 36 of the connector housing 30 is received in the pocket 41 of the connector housing 60. Referring also to FIG. 1F, and is described in more detail below, when the electrical connectors 22 and 26 are mated to each other, the mating portions 78 of the electrical contacts 76 extend through the respective receptacle pockets 45 and electrically connect to the mating portions 48 of the electrical contacts 46. Thus, each mating portion 48 can be operatively aligned with a corresponding receptacle pocket 45 such that the mating portions 78 can be inserted through the receptacle pockets 45 along a lateral insertion direction 37 and electrically connect to the mating portions 48 of the electrical contacts 46. The mounting portions 50 of the electrical contacts 46 can electrically connect to electrical traces of the first substrate 24 so as to place the electrical contacts in electrical communication with the substrate 24 and one or more electrical devices that are also connected to the substrate 24. Likewise, the mounting portions 80 of the electrical contacts 76 can electrically connect to electrical traces of the second substrate 28 so as to place the electrical contacts in electrical communication with the substrate 28 and one or more electrical devices that are also connected to the substrate 28. The mounting portions 50 and 80 are illustrated as eye-of-the-needle tails that can be press-fit into complementary apertures extending through the substrates 24 and 28, respectively. Alternatively, the mounting portions 50 and 80 can be configured to be surface mounted to the respective substrates 24 and 28. Thus, the electrical connectors 22 and 26 can be mated so as to place the substrates 24 and 28 in electrical communication.

In accordance with the illustrated embodiment, the mating portions 48 receive the mating portions 78. Thus, the electrical contacts 46 can be referred to as receptacle contacts and the electrical connector 22 can be referred to as a receptacle connector. The electrical contacts 76 can be referred to as header contacts and the electrical connector 26 can be referred to as a header connector. It should be appreciated, however that the electrical connectors 22 and 26 can be constructed in accordance with any suitable alternative embodiment without departing from the present disclosure. For instance, the first electrical connector 22 can alternatively be constructed as a header connector whose electrical contacts 46 are received by the electrical contacts 76 of the second electrical connector 26, which can alternatively be constructed as a receptacle connector.

Furthermore, in accordance with the illustrated embodiment, the mating interface 42 of the connector housing 30 is oriented substantially perpendicular with respect to the mounting interface 44, and the mating portions 48 of the electrical contacts 46 are substantially perpendicular with respect to the mounting portions 50. Thus, the electrical connector 22 can be referred to as a right-angle electrical connector, and is illustrated as a right-angle receptacle connector as described above. The mating interface 72 of the connector housing 60 is oriented substantially parallel with respect to the mounting interface 74, and the mating portions 78 of the electrical contacts 76 are substantially parallel to the mounting portions 80. Thus, the electrical connector 26 can be referred to as a vertical electrical connector, and is illustrated as a vertical header connector as described above. It should be appreciated, of course that the electrical connector 22 can alternatively be configured as a vertical electrical connector, and the electrical connector 26 can alternatively be configured as a right-angle electrical connector.

The electrical connectors 22 and 26 can be shielded or shieldless, that is the electrical connectors 22 and 26 may each include, or may be devoid of, shielding material between the adjacent electrical contacts 46, between the adjacent electrical contacts 76, or along the electrical contacts 46 and/or 76. For instance the grooves 35 disposed between adjacent ribs 52 of the first electrical connector 22 can contain an electrical contact which can be part of an electrically conductive top shield. The second electrical connector 26 can likewise contain electrically conductive pins disposed between adjacent ribs 67, such that the pins contact and thus electrically connect with the top shield of the first electrical connector 22 when the first and second electrical connectors 22 and 26 are mated. The first electrical connector 20 can define a plurality ribs 52 that extend transversely out from the housing 30 can be longitudinally aligned as illustrated, and grooves 35 that are disposed between adjacent ribs 52. The connector housing 30 can include a guidance member 59 in the form of a pair of forwardly projecting protrusions 61. The connector housing 60 further includes a plurality of ribs 67 that are configured to be received in the grooves 35 that are disposed between the adjacent ribs 52 of the electrical connector 22. Alternatively or additionally, some up to all of the electrical contacts 46, and some up to all of the electrical contacts 76, can contain or can be coated with any suitable conductive of nonconductive lossy material as desired to further reduce crosstalk between adjacent electrical contacts during operation.

Figure 2B:
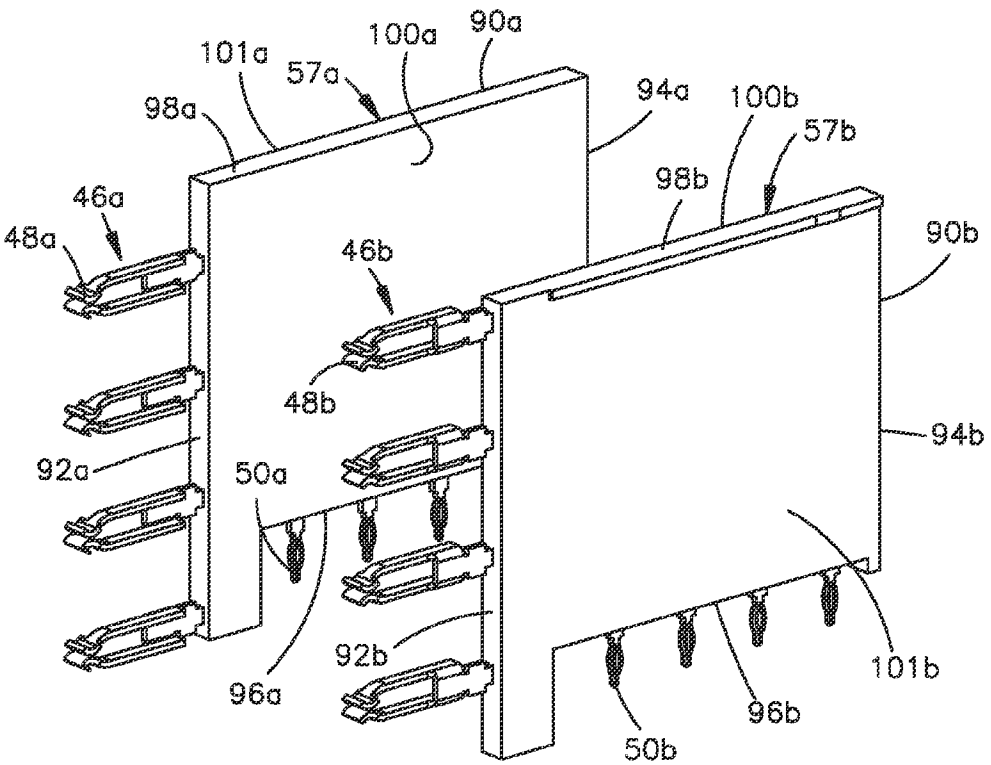
FIG. 2B is an exploded view of the first contact module illustrated in FIG. 2A, including a first leadframe assembly having a first leadframe housing that retains a first plurality of electrical contacts, and a second leadframe assembly having a second leadframe housing that retains a second plurality of electrical contacts.
Figure 2A:
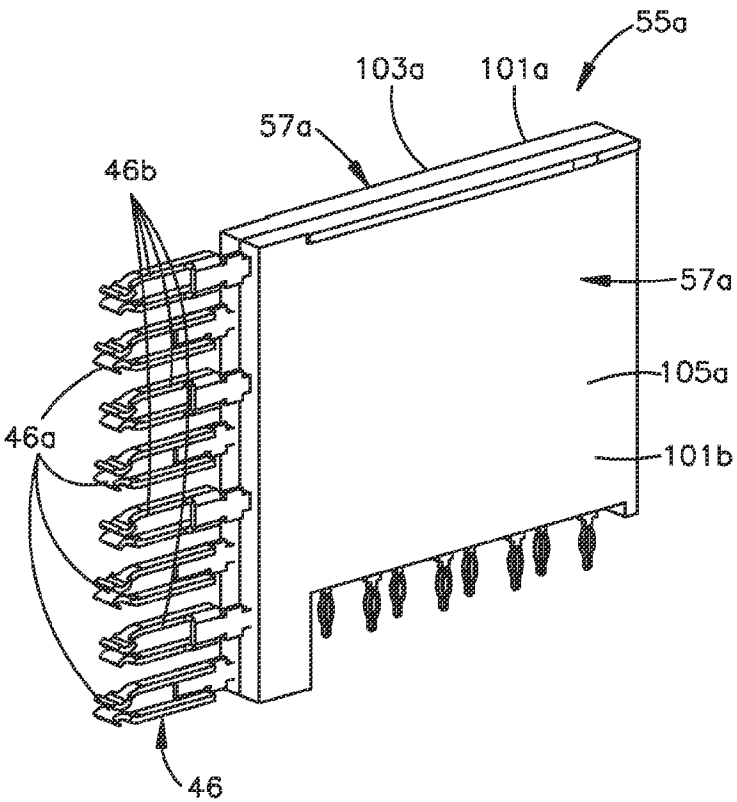
FIG. 2A is a perspective view of a first one of the contact modules illustrated in FIG. 1C, including a first leadframe assembly and a second leadframe assembly.
Figure 3A:
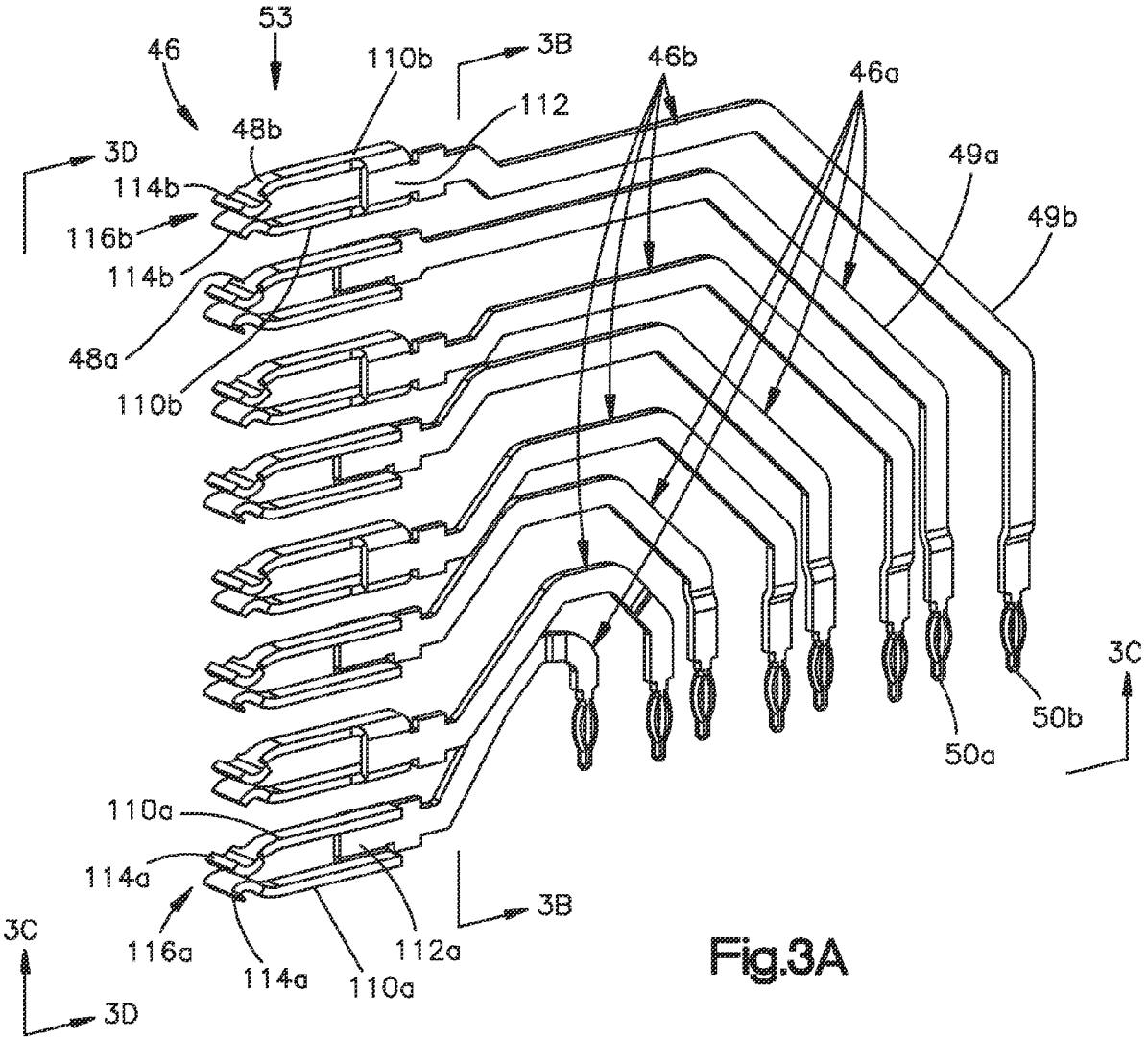
FIG. 3A is a perspective view of the first contact module illustrated in FIGS. 2A-B, with the first and second leadframe housings removed to reveal the first and second pluralities of electrical contacts.
Figure 9A:
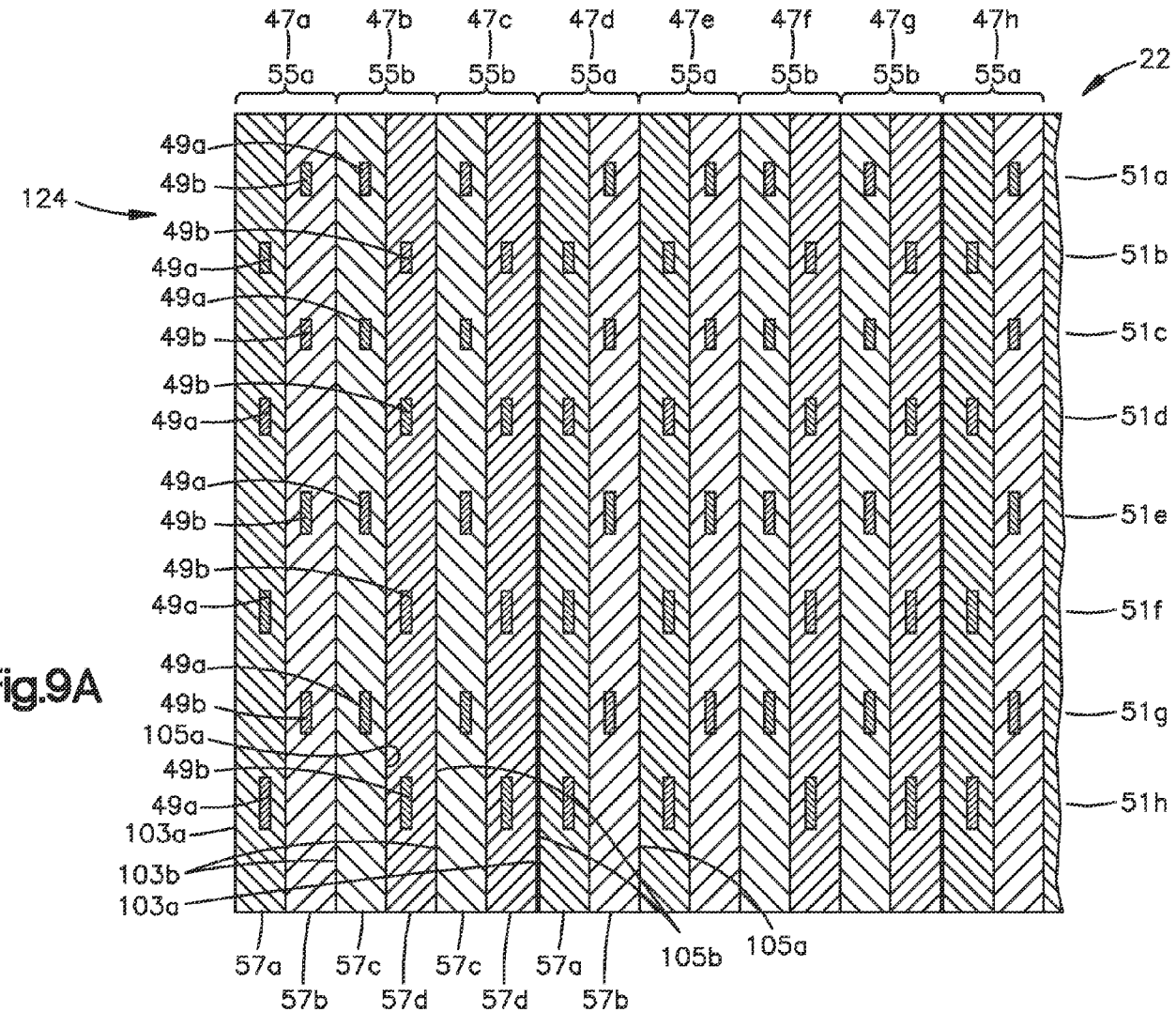
FIG. 9A is a sectional front elevation view of the contact modules illustrated in FIG. 1C, showing the first and second contact modules illustrated in FIGS. 2A and 5A in a first contact configuration.
Figure 10A:
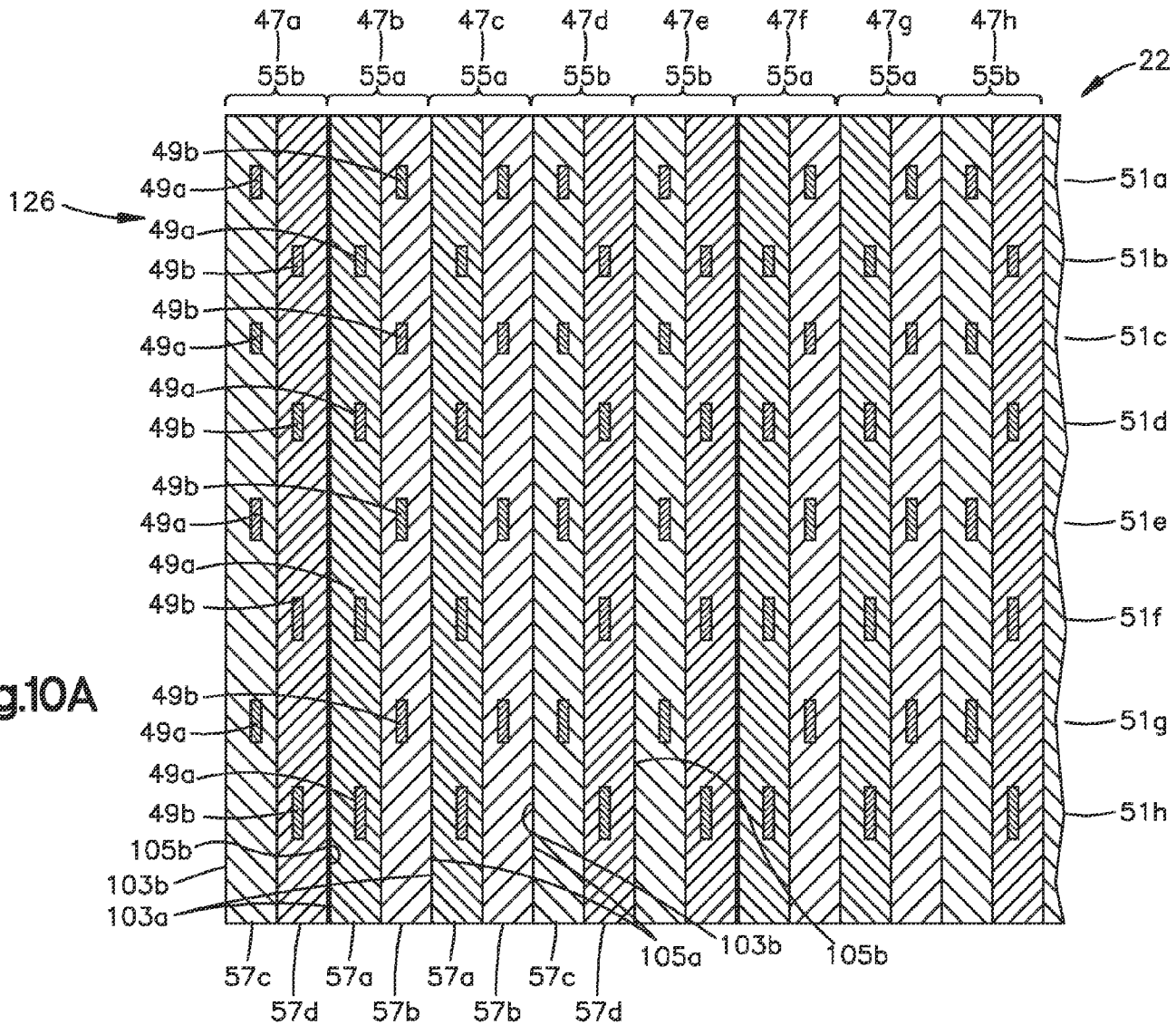
FIG. 10A is a sectional front elevation view of the contact modules illustrated in FIG. 1C, showing the first and second contact modules illustrated in FIGS. 2A and 5A in a second contact configuration that is different than the first configuration illustrated in FIG. 9A.

Referring now to FIGS. 2A-B, the contact modules 55 include a first contact module 55*a* that, in turn, includes a first leadframe assembly 57*a* and a second leadframe assembly 57*b* disposed immediately adjacent the first leadframe assembly 57*a*, and abutting the first leadframe assembly 57*a* as illustrated. The first leadframe assembly 57*a* includes a first leadframe housing 90*a* and a first plurality of electrical contacts 46*a* supported by the first leadframe housing 90*a*. The first leadframe assembly 57*a* can be provided as an insert molded leadframe assembly (IMLA) whereby the first leadframe housing 90*a* is overmolded onto the first plurality of electrical contacts 46*a*. The first leadframe housing 90*a* defines a front mating end 92*a* and an opposed rear end 94*a* that is laterally spaced from the front mating end 92*a*, a lower mounting end 96*a* and an upper end 98*a* that is transversely spaced from the lower mounting end 96*a*, and longitudinally opposed first and second inner and outer sides 100*a* and 101*a*, respectively. Each of the first plurality of electrical contacts 46*a* defines a mating portion 48*a* that extends forward from the front mating end 92*a* of the first leadframe housing 90*a*, and an opposed mounting portion 50*a* that extends down from the lower mounting end 96*a* of the first leadframe housing 90*a*. Referring also to FIG. 3A, each of the first plurality of electrical contacts 46*a* defines an intermediate portion 49*a* that extends between the mating portion 48*a* and the mounting portion 50*a*. At least a portion of the intermediate portion 49*a* is angled with respect to the mating portion 48*a* and mounting portion 50*a*. At least a portion of, for instance all of, the intermediate portion 49*a* of each of the first plurality of electrical contacts 46*a* is embedded in the first leadframe housing 96*a* and disposed between the first and second sides 100*a* and 101*a*. As illustrated in FIGS. 9A and 10A, the intermediate portions 49*a* are disposed closer to the first side 100*a* than the second side 101*a*.

Likewise, the second leadframe assembly 57*b* includes a second leadframe housing 90*b* and a second plurality of electrical contacts 46*b* supported by the second leadframe housing 90*b*. The second leadframe assembly 57*b* can be provided as an IMLA whereby the second leadframe housing 90*b* is overmolded onto the second plurality of electrical contacts 46*b*. The second leadframe housing 90*b* defines a front mating end 92*b* and an opposed rear end 94*b* that is laterally spaced from the front mating end 92*b*, a lower mounting end 96*b* and an upper end 98*b* that is transversely spaced from the lower mounting end 96*b*, and longitudinally opposed first and second inner and outer sides 100*b* and 101*b*, respectively. The inner side 100*b* faces the inner side 100*a* of the contact module 55*a*. Each of the first plurality of electrical contacts 46*b* defines a mating portion 48*b* that extends forward from the front mating end 92*b* of the second leadframe housing 90*b*, and an opposed mounting portion 50*b* that extends down from the lower mounting end 96*b* of the second leadframe housing 90*a*. Referring also to FIG. 3A, each of the second plurality of electrical contacts 46*b* defines an intermediate portion 49*b* that extends between, and as illustrated is connected between, the mating portion 48*b* and the mounting portion 50*b*. At least a portion of the intermediate portion 49*b* is angled with respect to the mating portion 48*b* and mounting portion 50*b*. At least a portion of, for instance all of, the intermediate portion 49*b* of each of the second plurality of electrical contacts 46*b* is embedded in the second leadframe housing 96*b* and disposed between the first and second sides 100*b* and 101*b*. As illustrated in FIGS. 9A and 10A, the intermediate portions 49*b* are disposed closer to the first side 100*b* than the second side 101*b*.

Referring also to FIG. 3A, the first electrical contacts 46*a* are regularly spaced along the first leadframe housing 90*a* in the common column direction 53. Likewise, the second electrical contacts 46*b* are regularly spaced along the second leadframe housing 90*b* in the common column direction 53. The first and second leadframe assemblies 57*a* and 57*b* are placed adjacent each other such that the respective first sides 100*a* and 100*b* face each other and the respective second sides 101*a* and 101*b* face away from each other. Thus, the respective second sides 101*a* and 101*b* of the leadframe assemblies 57*a* and 57*b* define first and second respective outer sides 103*a* and 105*a* of the first contact module 55*a*.

When the first and second leadframe assemblies 57*a* and 57*b* of the first contact module 55*a* are disposed adjacent each other, the first and second electrical contacts 46*a* and 46*b* are arranged along the common column direction 53 in an alternating pattern, such that the first electrical contacts 46*a* are disposed adjacent the second electrical contacts 46*b* along the common column direction 53, and the second electrical contacts 46*b* are disposed adjacent the first electrical contacts 46*a* along the common column direction 53. In particular, along the common column direction 53, the uppermost second electrical contact 46*b* defines the uppermost electrical contact 46 of the first contact module 55*a*, while the lowermost first electrical contact 46*a* defines the lowermost electrical contact 46 of the first contact module 55*a*. Each of the first plurality of electrical contacts 46*a* that are disposed transversely between adjacent ones of the second plurality of electrical contacts 46*b* are disposed midway between the adjacent ones of the second plurality of electrical contacts 46*b*. Likewise, each of the second plurality of electrical contacts 46*b* that are disposed transversely between adjacent ones of the first plurality of electrical contacts 46*a* are disposed midway between the adjacent ones of the first plurality of electrical contacts 46*a*.

Figure 3B:
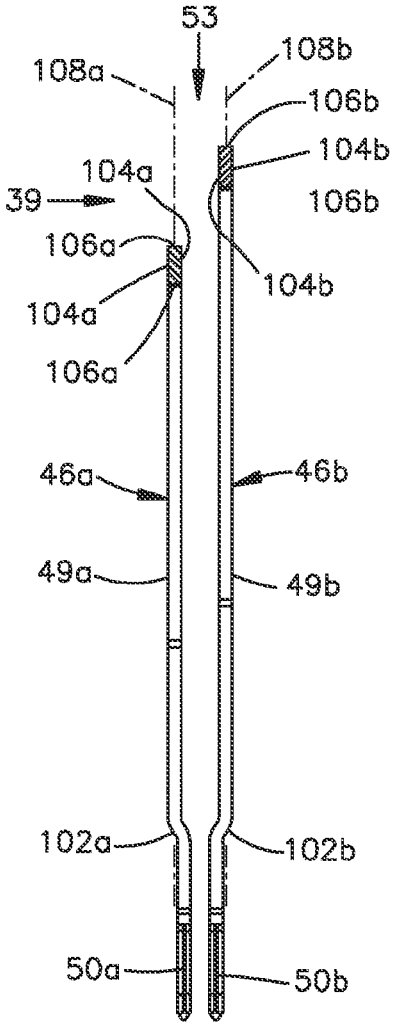
FIG. 3B is a sectional side elevation view of the first contact module illustrated in FIG. 3A, taken along line 3B-3B.
Figure 3C:
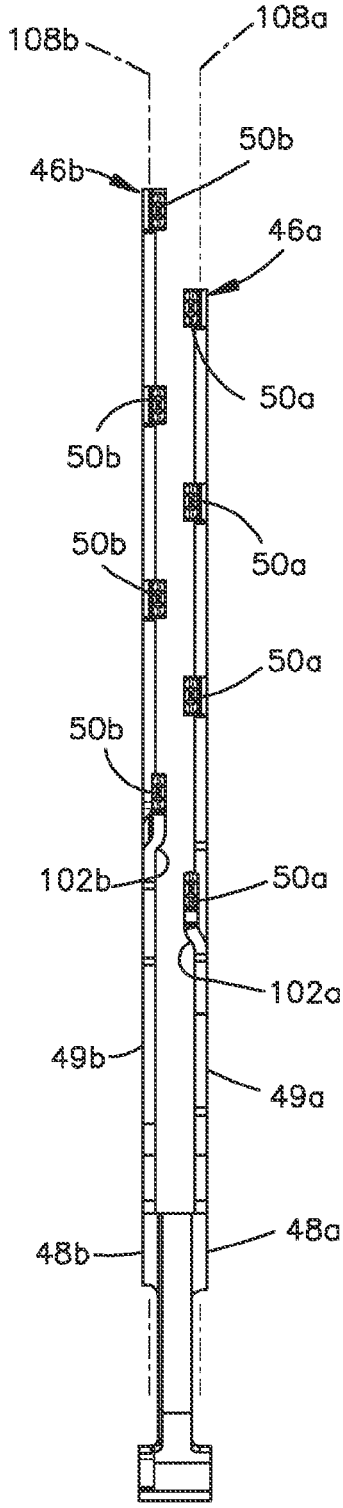
FIG. 3C is a bottom plan view of the of the first contact module illustrated in FIG. 3A.

Referring now also to FIGS. 3B-C, the mounting portions 50*a* of at least one or more up to all of the first plurality of electrical contacts 46*a* can be offset with respect to the respective intermediate portions 49*a*. Thus, the first plurality of electrical contacts 46*a* can be configured as offset electrical contacts. In particular, each of the first plurality of electrical contacts 46*a* includes a jogged interface 102*a* that joins the intermediate portion 49*a* and the mounting portion 50*a* so as to cause the mounting portion 50*a* to be offset with respect to the intermediate portion 49*a* in a direction toward the first side 100*a* of the first leadframe housing 90*a*. The mounting portion 50*a* extends in a direction parallel to the intermediate portion 49*a*. The intermediate portion 49*a* is illustrated as including a pair of opposing outer surfaces that define respective broadsides 104*a* that extend along the common column direction 53, and a pair of opposing outer surfaces that define edges 106*a* that are connected between the broadsides 104*a* along the common row direction 39. The broadsides 104*a* are thus also connected between the edges 106*a*. The broadsides 104*a* define a length between the opposing edges 106*a*, and the edges 106*a* define a length between the opposing broadsides 104*a*, such that the length of the broadsides 104*a* is greater than the length of the edges 106*a*. In this regard, it should be appreciated that the broadsides 104*a* face the first and second sides 100*a* and 101*a* of the first leadframe housing 90*a*.

Likewise, the mounting portions 50*b* of at least one or more up to all of the second electrical contacts 46*b* can be offset with respect to the respective intermediate portions 49*b*. In particular, each of the second plurality of electrical contacts 46*b* includes a jogged interface 102*b* that joins the intermediate portion 49*b* and the mounting portion 50*b* so as to causes the mounting portion 50*b* to be offset with respect to the intermediate portion 49*b* in a direction toward the first side 100*b* of the second leadframe housing 90*b*. The mounting portion 50*b* extends in a direction parallel to the intermediate portion 49*b*. The intermediate portion 49*b* is illustrated as including a pair of opposing outer surfaces that define respective broadsides 104*b* that extend along the common column direction 53, and a pair of opposing outer surfaces that define edges 106*b* that are connected between the broadsides 104 along the common row direction 39. The broadsides 104*b* are thus also connected between the edges 106*b*. The broadsides 104*b* define a length between the opposing edges 106*b*, and the edges 106*b* define a length between the opposing broadsides 104*b*, such that the length of the broadsides 104*b* is greater than the length of the edges 106*b*. In this regard, it should be appreciated that the broadsides 104*b* face the first and second sides 100*b* and 101*b* of the second leadframe housing 90*b*.

It should be further appreciated that the mounting portions 50*a* are offset with respect to their intermediate portions 49*a* in a direction toward the second plurality of electrical contacts 46*b*, and the mounting portions 50*b* are offset with respect to their intermediate portions 49*b* in a direction toward the first plurality of electrical contacts 46*a*. Otherwise stated, the mounting portions 50*a* of the first plurality of electrical contacts 46*a* and the mounting portions 50*b* of the second plurality of electrical contacts 46*b* of the first contact module 55*a* are offset toward each other, and offset from each other.

With continuing reference to FIGS. 2A-3C, the intermediate portions 49*a* of the first plurality of electrical contacts 46*a* are coplanar and are aligned or disposed on a first common plane 108*a* that extends vertically or in the transverse direction. Likewise, the intermediate portions 49*b* of the first plurality of electrical contacts 46*b* are coplanar and are aligned or disposed on a second common plane 108*b* that extends vertically or in the transverse direction. The first and second common planes 108*a* and 108*b* are thus parallel to each other, and extend along the common column direction 53. Thus, the first and second common planes 108*a* and 108*b* extend parallel to each other, and spaced from each other along the common row direction 39 when the first and second leadframe assemblies 57*a-b* are placed adjacent each other to form the first contact module 55*a*. The mounting portions 50*a* are offset with respect to the respective first common plane 108*a* in a direction toward the second common plane 108*b*, and the mounting portions 50*b* are offset with respect to the respective second common plane 108*b* in a direction toward the first common plane 108*a*.

Figure 4A:
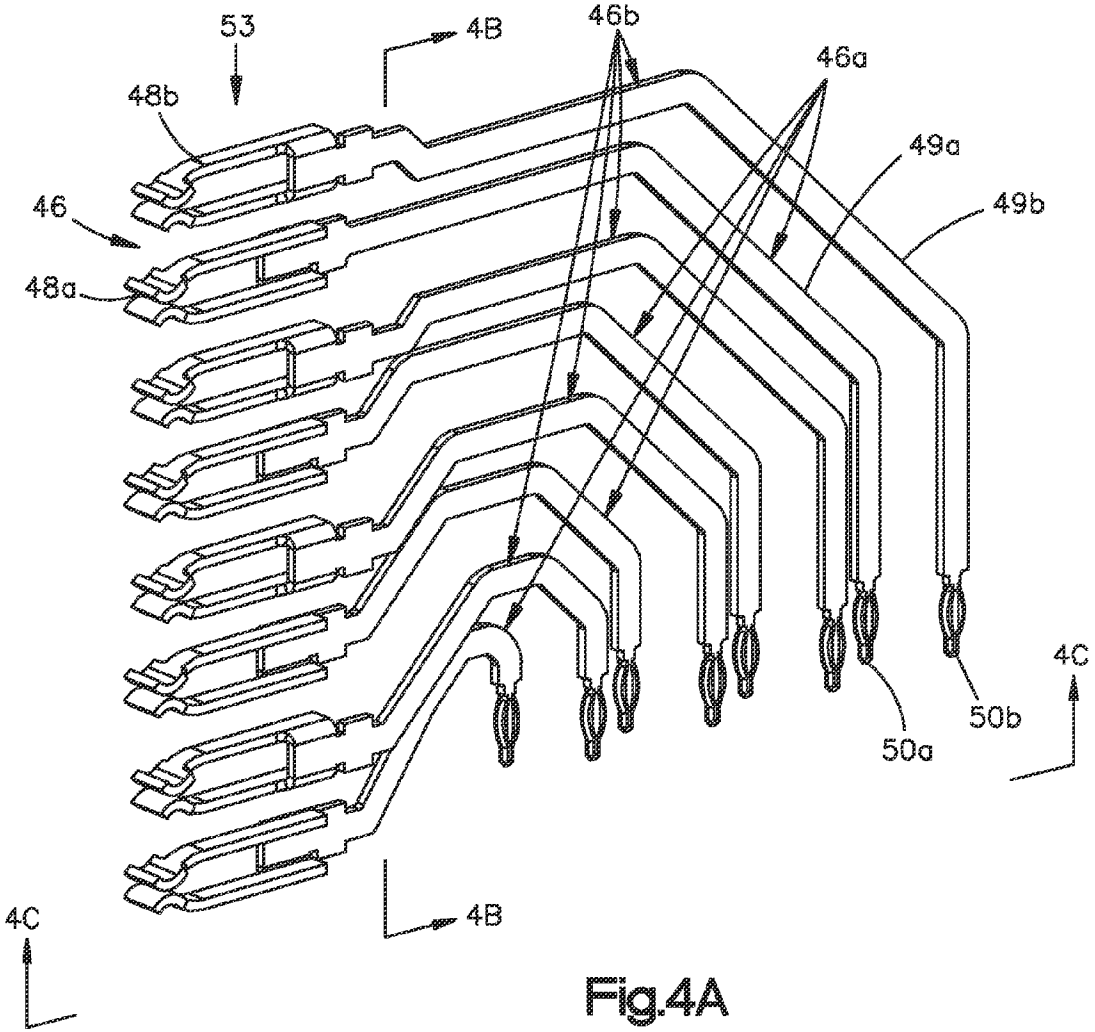
FIG. 4A is a perspective view of the first contact module illustrated in FIG. 3A, but showing the first and second pluralities of electrical contacts constructed in accordance with an alternative embodiment.
Figure 4B:
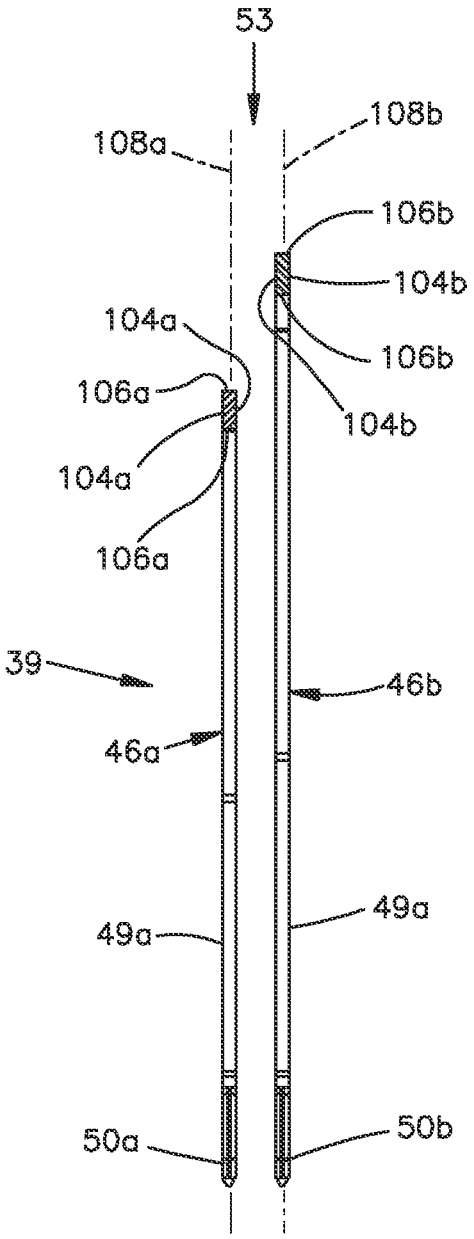
FIG. 4B is a sectional side elevation view of the first contact module illustrated in FIG. 4A, taken along line 4B-4B.
Figure 4C:
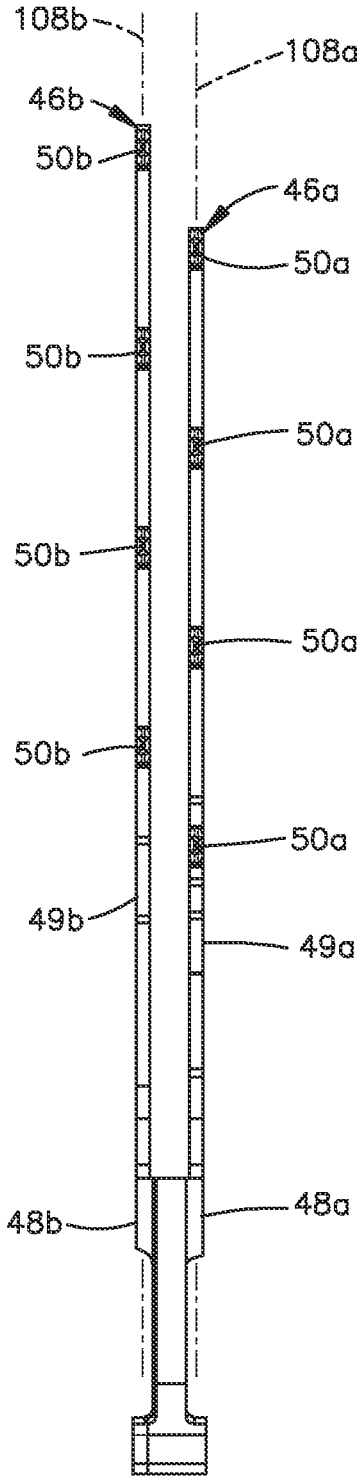
FIG. 4C is a bottom plan view of the contact module illustrated in FIG. 4A.

Alternatively, referring now to FIGS. 4A-C, the first plurality of electrical contacts 46*a* can be planar such that the intermediate portion 49*a* and the mounting portion 50*a* of one or more, up to all, of the first plurality of electrical contacts 46*a* are disposed on the first common plane 108*a*. Otherwise stated, the first electrical contacts 46*a* can be devoid of the jogged interface 102*a*, such that the intermediate portion 49*a* and the mounting portion 50*a* of one or more up to all of the first plurality of electrical contacts 46*a* are coplanar. It should thus be appreciated that one or more up to all of the first plurality of electrical contacts 46*a* of the first leadframe assembly 57*a* can include the jogged interface 102*a*, and that one or more up to all of the first plurality of electrical contacts 46*a* of the first leadframe assembly 57*a* can be devoid of the jogged interface 102*a*.

Likewise, the second plurality of electrical contacts 46*b* can be planar such that the intermediate portion 49*b* and the mounting portion 50*b* of one or more, up to all, of the second plurality of electrical contacts 46*b* are disposed on the first common plane 108*b*. Otherwise stated, the second electrical contacts 46*b* can be devoid of the jogged interface 102*b*, such that the intermediate portion 49*b* and the mounting portion 50*b* of one or more up to all of the second plurality of electrical contacts 46*b* are coplanar. It should thus be appreciated that one or more up to all of the second plurality of electrical contacts 46*b* of the second leadframe assembly 57*b* can include the jogged interface 102*b*, and that one or more up to all of the second plurality of electrical contacts 46*b* of the second leadframe assembly 57*b* can be devoid of the jogged interface 102*b*.

Figure 3D:
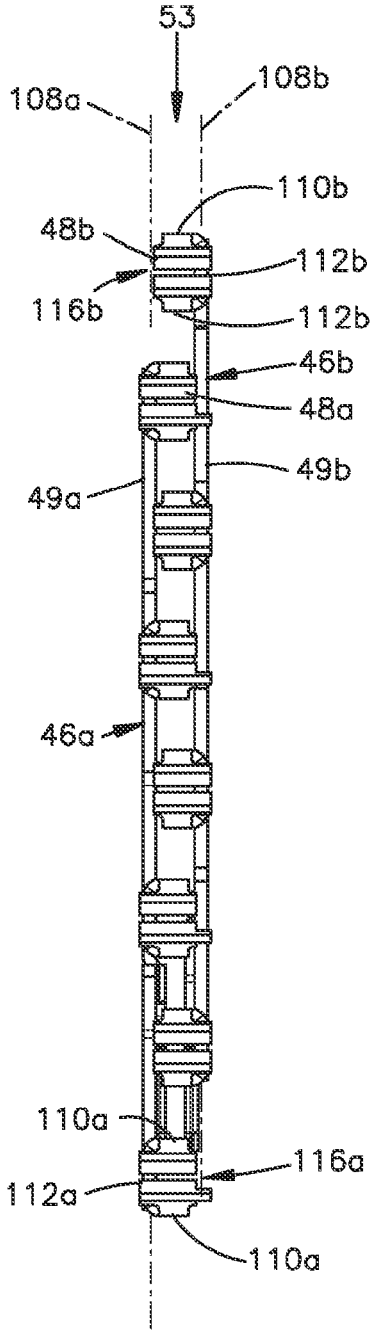
FIG. 3D is a front elevation view of the first contact module illustrated in FIG. 3A.

Referring now to FIGS. 3A and 3D, the mating portions 48*a* of the first plurality of electrical contacts extend from a location aligned with the respective intermediate portions 49*a*, and thus also aligned with the first common plane 108*a*, in a longitudinal direction substantially perpendicular to the insertion direction 37 (see FIG. 1F) and toward the first side 100*a* of the first leadframe housing 90*a*. Otherwise stated, the mating portions 48*a* extend toward the second leadframe assembly 57*b* and thus the second plurality of electrical contacts 46*b* of the second leadframe assembly 57*b*. In particular, the first mating portion 48*a*, is generally c-shaped, and includes transversely opposed arms 110*a* that extend laterally forward from the intermediate portions 49*a*. The first mating portion 48*a* further includes a leg 112*a* that is connected between the arms 110*a* such that the arms 110*a* extend from the leg 112*a* toward the first side 100*a* of the first leadframe housing 90*a*. The leg 112*a* can be disposed in the common plane 108*a*, and thus aligned with the intermediate portion 49*a*.

Figure 8:
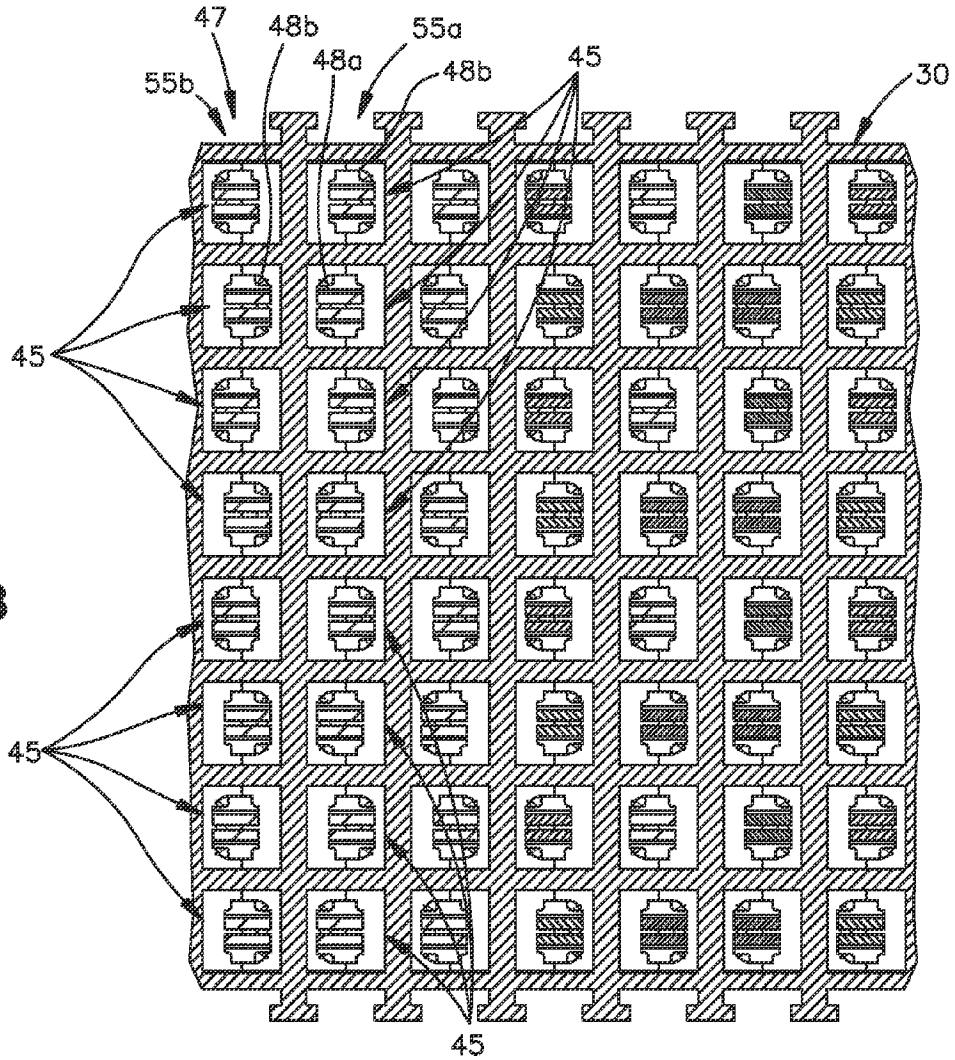
FIG. 8 is a sectional front elevation view of the first electrical connector illustrated in FIG. 1B showing a mating interface.

The first mating portions 48*a* can further include first and second contact beams 114*a* that extend forward from the arms 110*a*, and are transversely opposed so as to define a receptacle 116*a* therebetween that is configured to receive the mating portions 78 of the corresponding second plurality of electrical contacts 76. The front ends of the contact beams 114*a* can flare toward each other so as to provide a retention spring force against the mating portions 78 when the mating portions 78 are received in the receptacles 116*a*. As illustrated in FIG. 8, the receptacle pockets 45 of the connector housing 30 are aligned with the mating portions 48*a* of the first plurality of electrical contacts 46*a*. For instance, the receptacles 116*a* defined by the first and second contact beams 114*a* are operatively aligned with the receptacle pockets 45 such that the mating portions 78 can be inserted through the receptacle pockets 45 along the insertion direction 37 and into the receptacles 116*a* such that both contact beams 114*a* contact the received mating portion 78, thereby establishing an electrical connection between the electrical contacts 80 and the first plurality of electrical contacts 46*a*. Otherwise stated, a plurality of the receptacle pockets 45 is aligned with a select one of the mating portions 48*a* of the first plurality of electrical contacts 46*a*.

Likewise, with continuing reference to FIGS. 3A and 3D, the mating portions 48*b* of the second plurality of electrical contacts 46*b* extend from a location aligned with the respective intermediate portions 49*b*, and thus also aligned with the second common plane 108*b*, in a longitudinal direction substantially perpendicular to the insertion direction 37 (see FIG. 1F) and toward the first side 100*b* of the second leadframe housing 90*b*. Otherwise stated, the mating portions 48*b* extend toward the first leadframe assembly 57*a* and thus the first plurality of electrical contacts 46*a* of the first leadframe assembly 57*a*. In particular, the second mating portion 48*b* is generally c-shaped, and includes transversely opposed arms 110*b* that extend laterally forward from the intermediate portions 49*b*. The second mating portion 48*b* further includes a leg 112*b* that is connected between the arms 110*b* such that the arms 110*b* extend from the leg 112*b* toward the first side 100*b* of the first leadframe housing 90*b*. The leg 112*b* can be disposed in the common plane 108*b*, and thus aligned with the intermediate portion 49*b*.

The second mating portions 48*b* can further include first and second contact beams 114*b* that extend forward from the arms 110*b*, and are transversely opposed so as to define a receptacle 116*b* therebetween that is configured to receive the mating portions 78 of the corresponding second plurality of electrical contacts 76. The front ends of the contact beams 114*b* can flare toward each other so as to provide a retention spring force against the mating portions 78 when the mating portions 78 are received in the receptacles 116*b*. As illustrated in FIG. 8, the receptacle pockets 45 of the connector housing 30 are aligned with the mating portions 48*b* of the first plurality of second plurality of electrical contacts 46*b*. For instance, the receptacles 116*b* defined by the first and second contact beams 114*b* are operatively aligned with the receptacle pockets 45 such that the mating portions 78 can be inserted through the receptacle pockets 45 along the insertion direction 37 and into the receptacles 116*b* such that both contact beams 114*b* contact the received mating portion 78, thereby establishing an electrical connection between the electrical contacts 80 and the second plurality of electrical contacts 46*b*. Otherwise stated, a plurality of the receptacle pockets 45 is aligned with a select one of the mating portions 48*b* of the second plurality of electrical contacts 46*b*. Thus, each of the receptacle pockets 45 is aligned with a select one of the mating portions 48*a* of the first plurality of electrical contacts 46*a* and the mating portions 48*b* of the second plurality of electrical contacts 46*b*. Furthermore, the receptacles 116*a* and 116*b* are at least partially aligned with each other with respect to the common column direction 53.

Figure 5B:
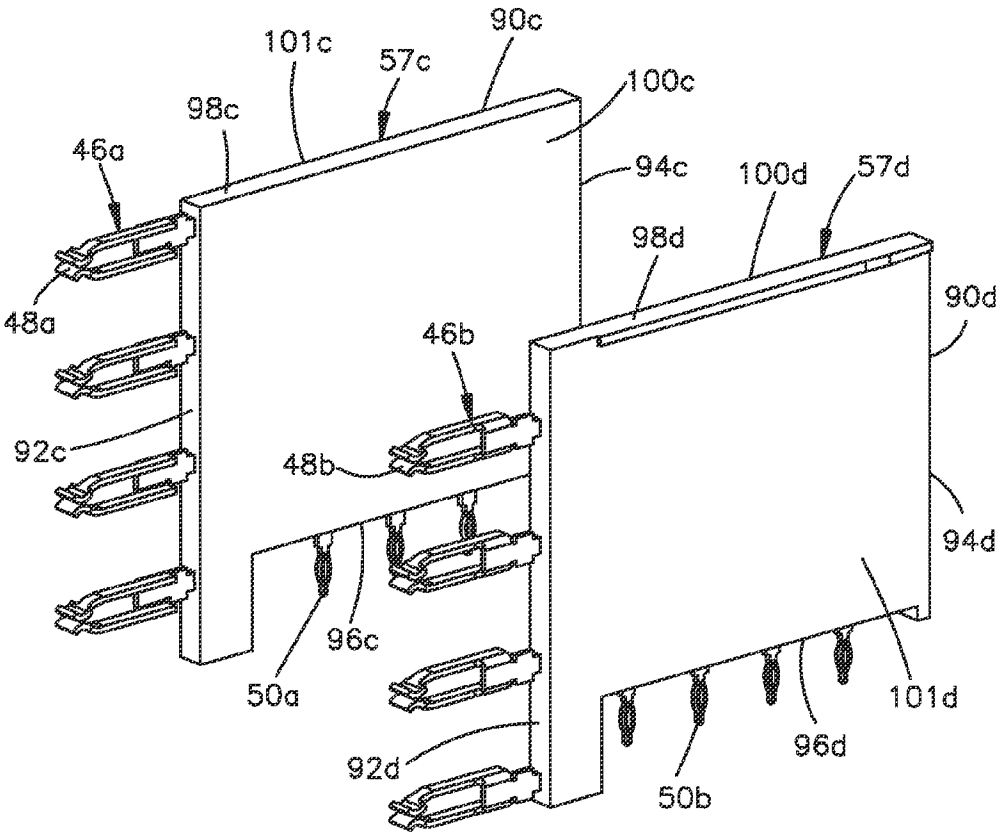
FIG. 5B is an exploded view of the first contact module illustrated in FIG. 5A, including the third leadframe assembly having a third leadframe housing that retains the first plurality of electrical contacts such that the first plurality of electrical contacts have a different placement in the third leadframe housing than in the first leadframe housing illustrated in FIG. 2B, and the fourth leadframe assembly having a fourth leadframe housing that retains the second plurality of electrical contacts such that the second plurality of electrical contacts have a different placement in the fourth leadframe housing than in the second leadframe housing illustrated in FIG. 2B.
Figure 5A:
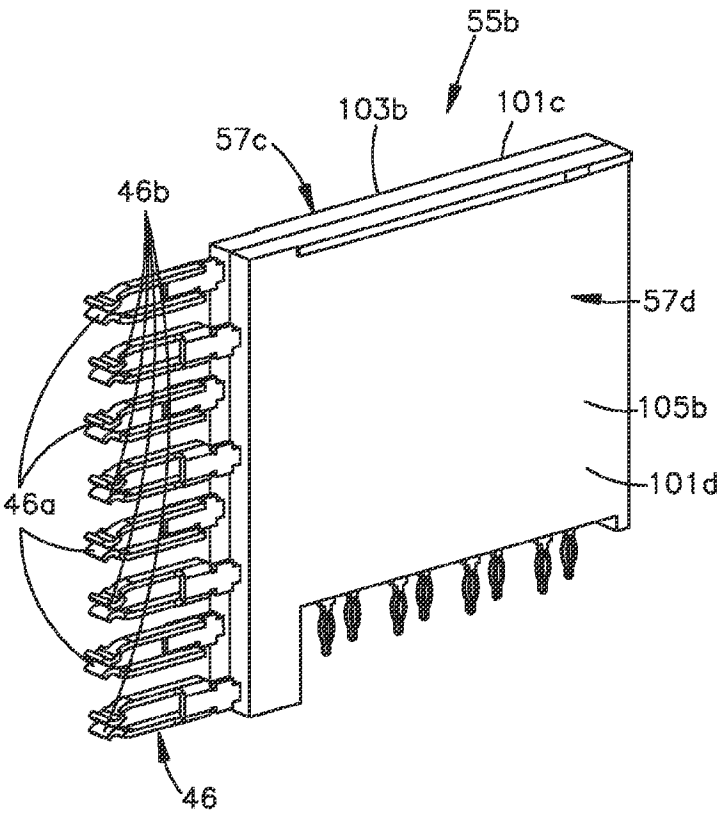
FIG. 5A is a perspective view of a second one of the contact modules illustrated in FIG. 1C, including a third leadframe assembly and a fourth leadframe assembly.
Figure 6A:
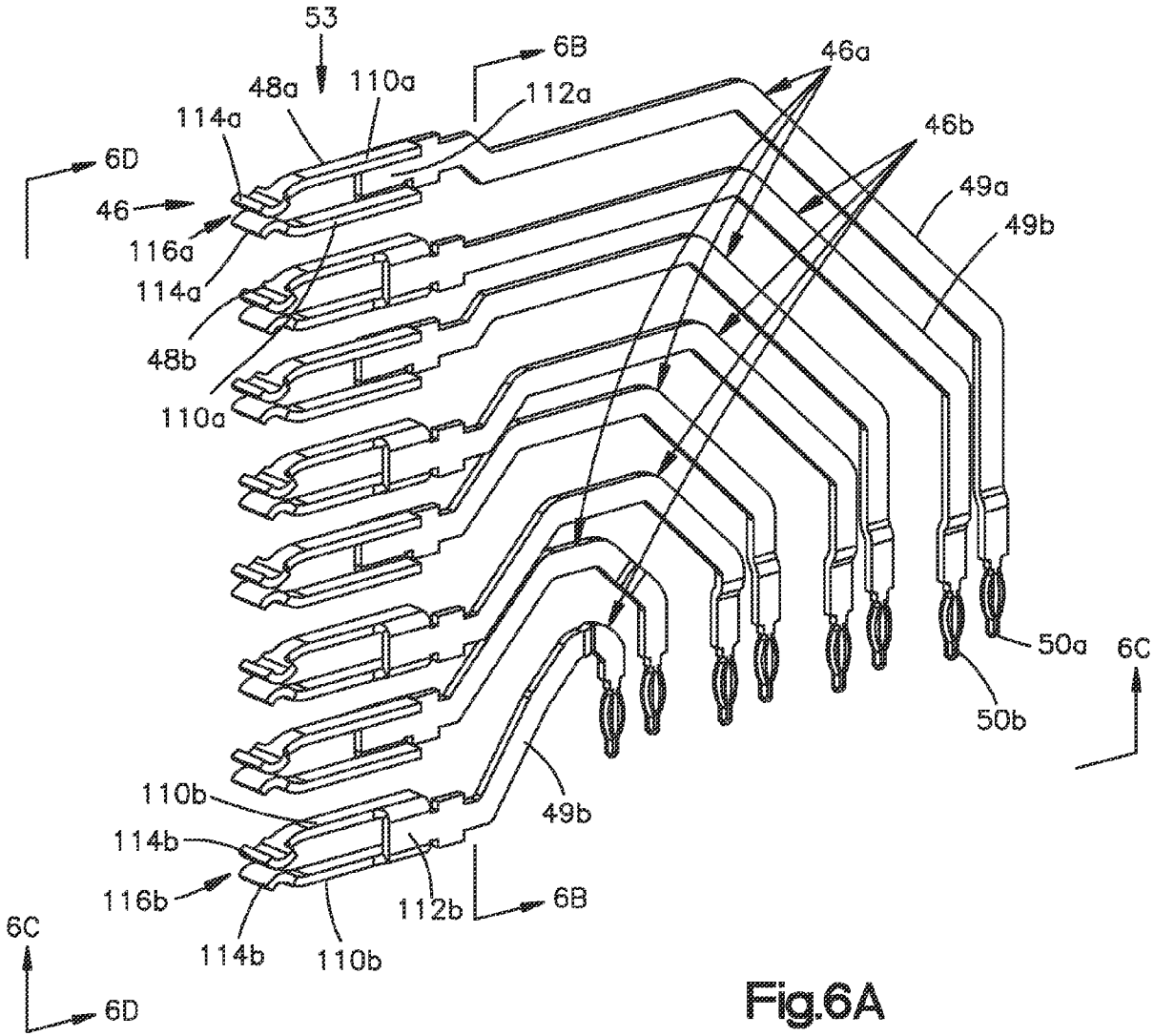
FIG. 6A is a perspective view of the second contact module illustrated in FIGS. 5A-B, with the third and fourth leadframe housings removed to reveal the third and fourth pluralities of electrical contacts.
Figure 6B:
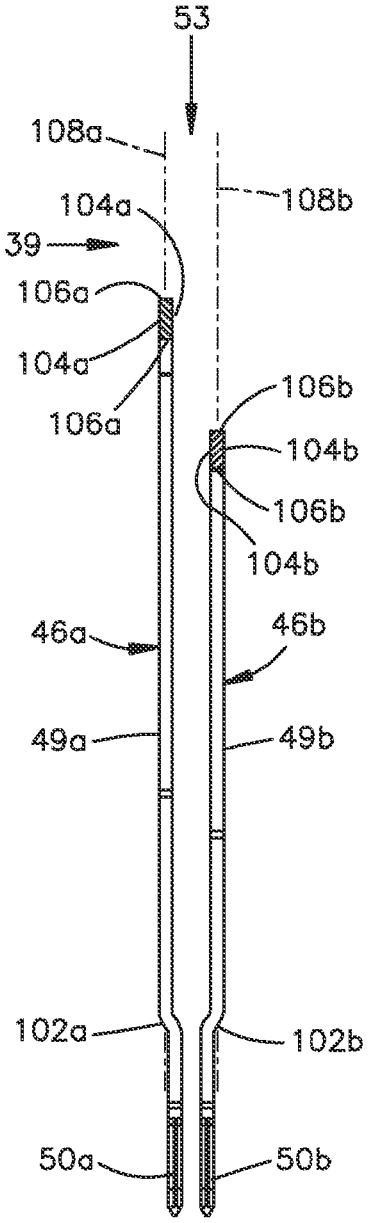
FIG. 6B is a sectional side elevation view of the second contact module illustrated in FIG. 6A, taken along line 6B-6B.
Figure 6C:
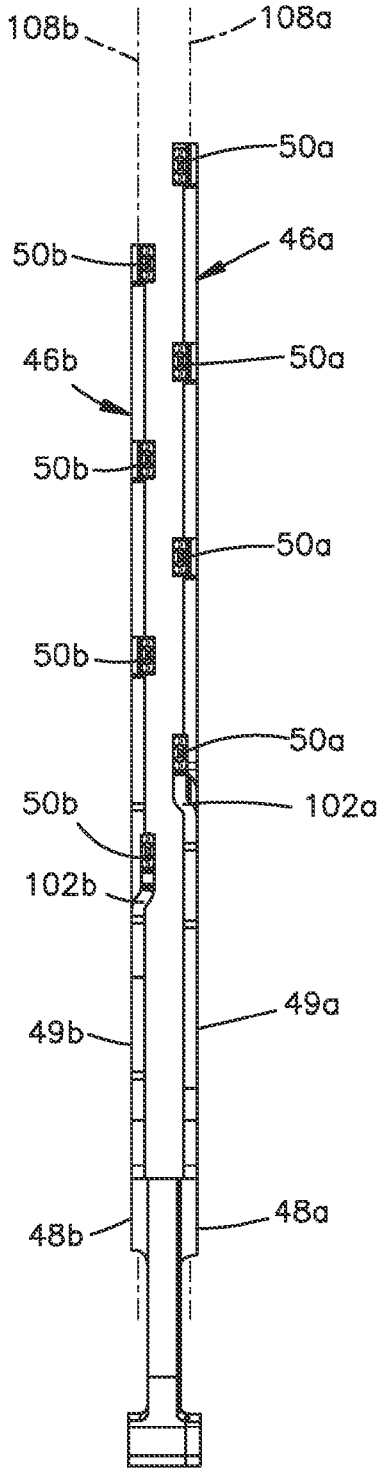
FIG. 6C is a bottom plan view of the of the second contact module illustrated in FIG. 6A.
Figure 6D:
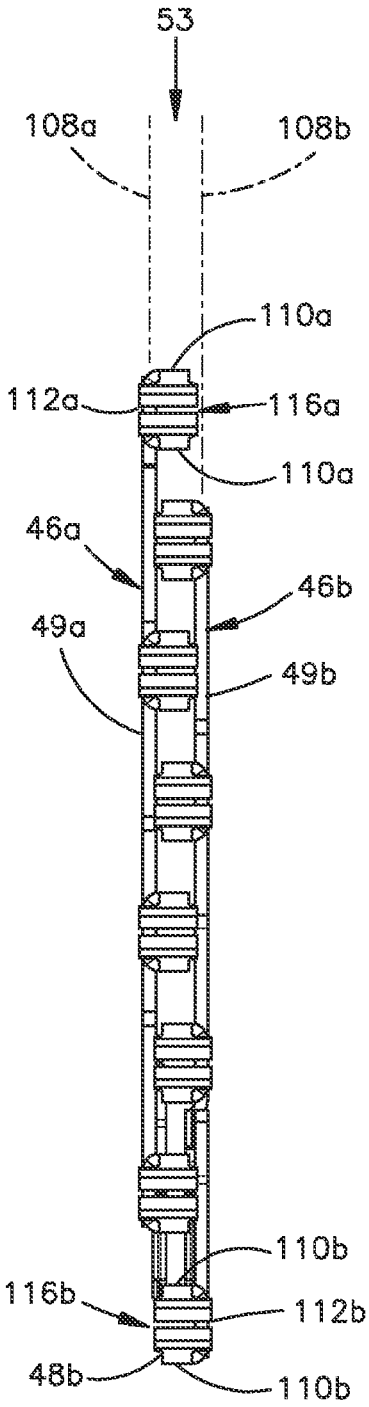
FIG. 6D is a front elevation view of the second contact module illustrated in FIG. 6A.
Figure 7A:
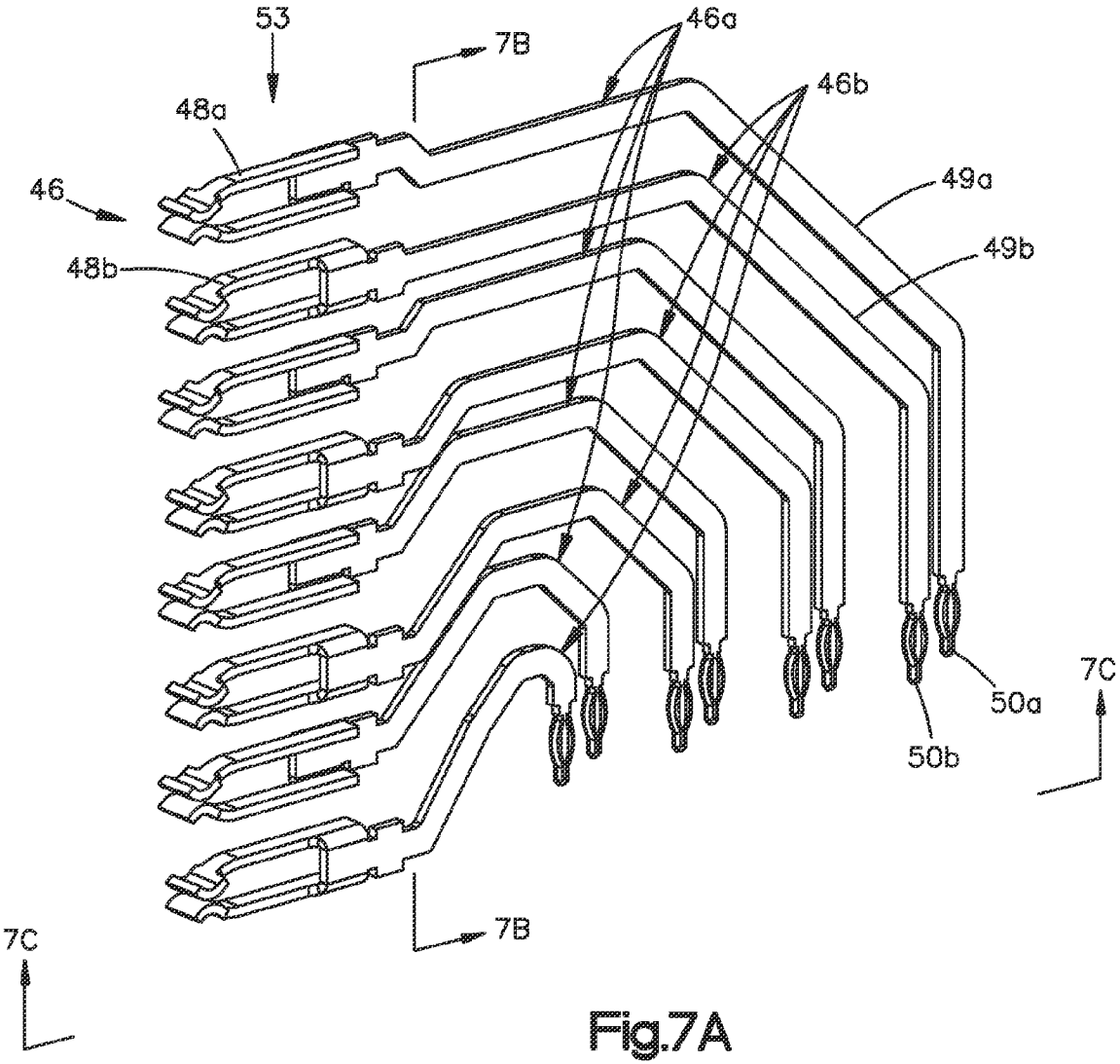
FIG. 7A is a perspective view of the second contact module illustrated in FIG. 6A, but showing the third pluralities of electrical contacts constructed in accordance with an alternative embodiment.
Figure 7B:
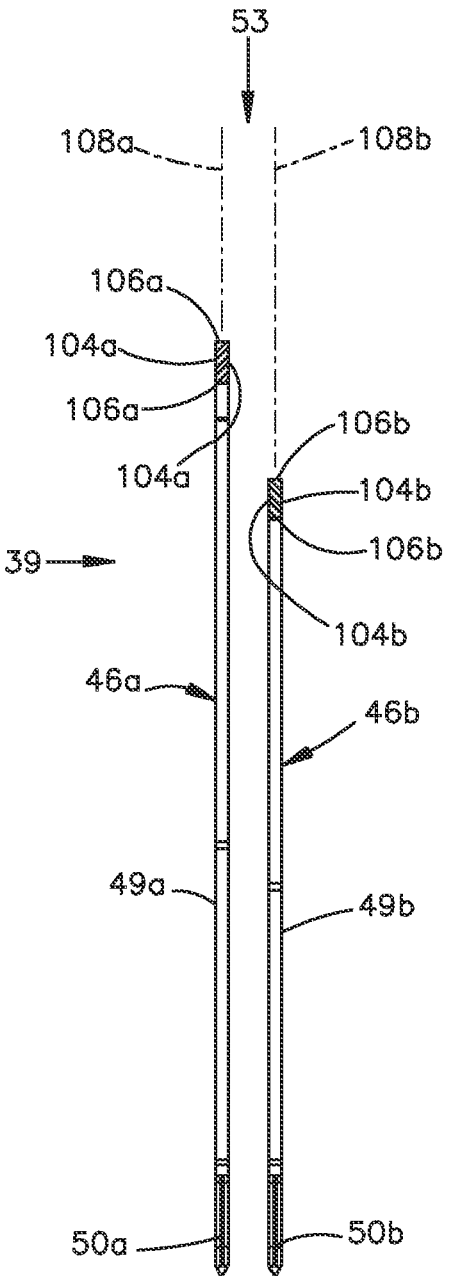
FIG. 7B is a sectional side elevation view of the second contact module illustrated in FIG. 7A, taken along line 7B-7B.
Figure 7C:
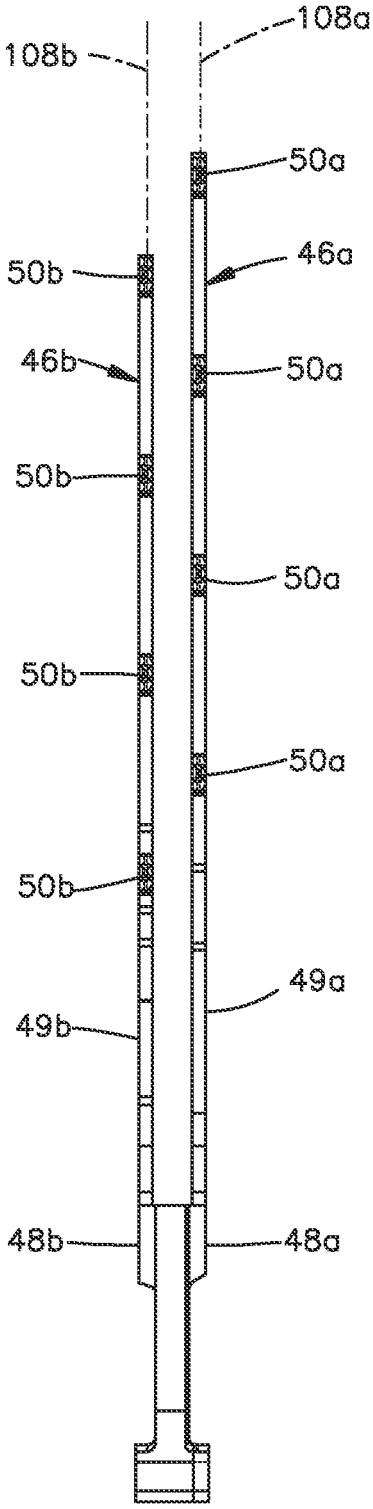
FIG. 7C is a bottom plan view of the contact module illustrated in FIG. 7A.

Referring now to FIGS. 5A-7C, the contact modules 55 include a second contact module 55*b* that, in turn, includes a third leadframe assembly 57*c* and a fourth leadframe assembly 57*d* disposed immediately adjacent the third leadframe assembly 57*c*, and abutting the third leadframe assembly 57*c* as illustrated. The third leadframe assembly 57*c* includes a third leadframe housing 90*c* and the first plurality of electrical contacts 46*a* supported by the third leadframe housing 90*c*. The first plurality of electrical contacts 46*a* of the third leadframe assembly 57*c* are constructed as described above with respect to the first plurality of electrical contacts 46*a* of the first leadframe assembly 57*a*. For instance, the first plurality of electrical contacts 46*a* of the second contact module 55*b* can include the jogged interface 102*a* as illustrated in FIGS. 6A-D, or can be planar and devoid of the jogged interface 102*a* as illustrated in FIGS. 7A-C. However, the first plurality of electrical contacts 46*a* are placed differently in the third leadframe housing 90*c*, for instance at different locations in third leadframe housing 90*c*, with respect to the placement of the first plurality of electrical contacts 46*a* in the first leadframe housing 90*a*, as is described in more detail below.

The fourth leadframe assembly 57*d* includes a fourth leadframe housing 90*d* and the second plurality of electrical contacts 46*b* supported by the fourth leadframe housing 90*d*. The second plurality of electrical contacts 46*b* of the fourth leadframe assembly 57*d* are constructed as described above with respect to the second plurality of electrical contacts 46*b* of the second leadframe assembly 57*b*. For instance, the second plurality of electrical contacts 46*b* of the second contact module 55*b* can include the jogged interface 102*b* as illustrated in FIGS. 6A-D, or can be planar and devoid of the jogged interface 102*b* as illustrated in FIGS. 7A-C. However, the second plurality of electrical contacts 46*b* are placed differently in the fourth leadframe housing 90*d*, for instance at different locations in fourth leadframe housing 90*d*, with respect to the placement of the second plurality of electrical contacts 46*b* in the second leadframe housing 90*b*, as is described in more detail below.

The third leadframe assembly 57*c* can be provided as an insert molded leadframe assembly (IMLA) whereby the third leadframe housing 90*c* is overmolded onto the first plurality of electrical contacts 46*a*. The third leadframe housing 90*c* defines a front mating end 92*c* and an opposed rear end 94*c* that is laterally spaced from the front mating end 92*c*, a lower mounting end 96*c* and an upper end 98*c* that is transversely spaced from the lower mounting end 96*c*, and longitudinally opposed first and second inner and outer sides 100*c* and 101*c*, respectively. The mating portion 48*a* of each of the first plurality of electrical contacts 46*a* extends forward from the front mating end 92*c* of the third leadframe housing 90*c*, and the mounting portion 50*a* of each of the first plurality of electrical contacts 46*a* extends down from the lower mounting end 96*c*. At least a portion of, for instance all of, the intermediate portion 49*a* of each of the first plurality of electrical contacts 46*a* is embedded in the third leadframe housing 96*c* and disposed between the first and second sides 100*c* and 101*c*. As illustrated in FIGS. 9A and 10A, the intermediate portions 49*a* are disposed closer to the first side 100*c* than the second side 101*c*.

Likewise, the fourth leadframe assembly 57*d* can be provided as an insert molded leadframe assembly (IMLA) whereby the fourth leadframe housing 90*d* is overmolded onto the second plurality of electrical contacts 46*b*. The fourth leadframe housing 90*d* defines a front mating end 92*d* and an opposed rear end 94*d* that is laterally spaced from the front mating end 92*d*, a lower mounting end 96*d* and an upper end 98*d* that is transversely spaced from the lower mounting end 96*d*, and longitudinally opposed first and second inner and outer sides 100*d* and 101*d*, respectively. The inner side 100*d* faces the inner side 100*c* of the second contact module 55*b*. The mating portion 48*b* of each of the second plurality of electrical contacts 46*b* extends forward from the front mating end 92*d* of the fourth leadframe housing 90*d*, and the mounting portion 50*b* of each of the second plurality of electrical contacts 46*b* extends down from the lower mounting end 96*d*. At least a portion of, for instance all of, the intermediate portion 49*b* of each of the second plurality of electrical contacts 46*b* is embedded in the fourth leadframe housing 96*d* and disposed between the first and second sides 100*d* and 101*d*. As illustrated in FIGS. 9A and 10A, the intermediate portions 49*b* are disposed closer to the first side 100*d* than the second side 101*d*.

Thus, the first leadframe housing 90*a*, the second leadframe housing 90*b*, the third leadframe housing 90*c*, and the fourth leadframe housing 90*d* are all constructed substantially identical to each other.

Referring also to FIG. 6A, the first electrical contacts 46*a* are regularly spaced along the third leadframe housing 90*c* in the common column direction 53. Likewise, the second electrical contacts 46*b* are regularly spaced along the fourth leadframe housing 90*d* in the common column direction 53. The third and fourth leadframe assemblies 57*c* and 57*d* are placed adjacent each other such that the respective first sides 100*c* and 100*d* face each other and the respective second sides 101*c* and 101*d* face away from each other. Thus, the respective second sides 101*c* and 101*c* of the leadframe assemblies 57*c* and 57*d* define first and second respective outer sides 103*b* and 105*b* of the second contact module 55*a*.

As described above, the first plurality of electrical contacts 46*a* are positioned differently in the third leadframe housing 90*c* than in the first leadframe housing 90*a*, and the second plurality of electrical contacts 46*b* are positioned differently in the fourth leadframe housing 90*d* than in the second leadframe housing 90*b*. In particular, when the third and fourth leadframe assemblies 57*c* and 57*d* of the second contact module 55*b* are disposed adjacent each other, the first and second electrical contacts 46*a* and 46*b* are arranged along the common column direction 53 in an alternating pattern, such that the first electrical contacts 46*a* are disposed adjacent the second electrical contacts 46*b* along the common column direction 53, and the second electrical contacts 46*b* are disposed adjacent the first electrical contacts 46*a* along the common column direction 53. In particular, along the common column direction 53, the uppermost one of the first plurality of electrical contacts 46*a* defines the uppermost electrical contact 46 of the second contact module 55*b* (as opposed to the uppermost one of the second plurality of electrical contacts 46*b* of the first contact module 55*a*), while the lowermost one of the second plurality of electrical contacts 46*b* defines the lowermost electrical contact 46 of the second contact module 55*b* (as opposed to the lowermost one of the first plurality of electrical contacts 46*a* of the first contact module 55*a*). Thus, the position of the first and second pluralities of electrical contacts 46*a* and 46*b* relative to each other along the common column direction 53 differ in the first and contact modules 55*a* and 55*b*, respectively.

Referring now to FIGS. 9A and 10A, the first electrical connector 22 is illustrated having eight consecutive columns 47*a-h*, and eight consecutive rows 51*a-h*, though as described above the electrical connector 22 can include any number of columns 47 and rows 51 as desired. In accordance with the illustrated embodiment, the row 51*a* is the uppermost row and the row 51*h* is the lowermost row. The number of columns 47 can be the same or different than the number of rows 51. The intermediate portions 49*a* of the first plurality of electrical contacts 46*a* of the first contact module 55*a* are disposed in rows 51*b*, 51*d*, 51*f*, and 51*h*, and the intermediate portions 49*b* of the second plurality of electrical contacts 46*b* of the first contact module 55*a* are disposed in rows 51*a*, 51*c*, 51*e*, and 51*g*. The intermediate portions 49*a* of the first plurality of electrical contacts 46*a* of the second contact module 55*b* are disposed in rows 51*a*, 51*c*. 51*e*, and 51*g*, and the intermediate portions 49*b* of the second plurality of electrical contacts 46 of the second contact module 55*b* are disposed in rows 51*b*, 51*d*, 51*f*, and 51*h*.

Figure 9B:
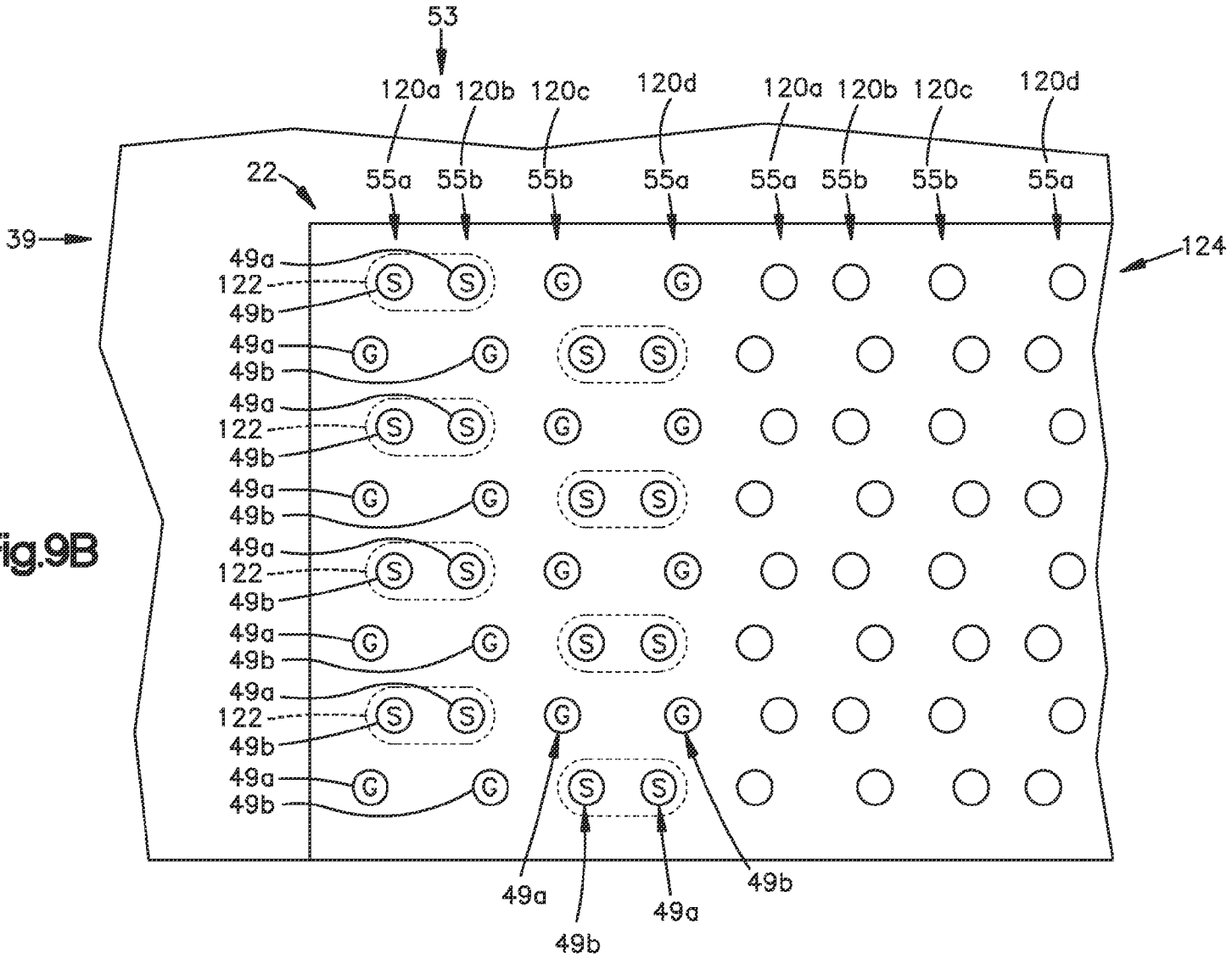
FIG. 9B is a schematic view of the of the first and second pluralities of electrical contacts of the contact modules illustrated in FIG. 9A.

Referring now to FIGS. 9A-B in particular, the electrical connector 22 is arranged in a first contact configuration 124 of immediately adjacent contact modules in a repeating 55*a*-55*b*-55*b*-55*a* configuration, such that no contact modules are disposed between the immediately adjacent contact modules. As illustrated, the first contact module 55*a* is disposed in columns 47*a*, 47*d*, 47*e*, and 47*h*, and the second contact module 55*b* is disposed in columns 47*b*, 47*c*, 47*f*, and 47*g*. Thus, in accordance with the embodiment illustrated in FIGS. 9A-B, the electrical connector includes a first contact module 120*a* provided as the first contact module 55*a*, a second contact module 120*b* provided as the second contact module 55*b*, a third contact module 120*c* provided as the second contact module 55*b*, and a fourth contact module 120*d* provided as the first contact module 55*a*.

Referring now to FIGS. 2A-B, 5A-B, and 9A-B, in the first contact configuration 124, the first and contact modules 120*a* and 120*b* are provided such that the second side 105*a* of the first contact module 55*a* (see FIG. 2A) is disposed adjacent the first side 103*b* of the second contact module 55*b* (see FIG. 5A). Thus, the second outer side 101*b* of the second leadframe assembly 57*b* is disposed adjacent the second outer side 101*c* of the third leadframe assembly 57*c*. Each of the second plurality of electrical contacts 49*b* of the first contact module 55*a* is disposed in the same row as each of the first plurality of electrical contacts 49*a* of the second contact module 55*b*. Likewise, each of the first plurality of electrical contacts 49*a* of the first contact module 55*a* is disposed in the same row as each of the second plurality of electrical contacts 49*b* of the second contact module 55*b*.

The intermediate portions 49*a* of the first plurality of electrical contacts 46*a* of the first contact module 55*a* are disposed closer to the first side 103*a* than the second side 105*a*. The intermediate portions 49*b* of the second plurality of electrical contacts 46*b* of the first contact module 55*a* are disposed closer to the second side 105*a* than the first side 103*a*. The intermediate portions 49*a* of the second contact module 55*b* are disposed closer to the first side 103*b* than the second side 105*b*. The intermediate portions 49*b* of the second contact module 55*b* are disposed closer to the second side 105*b* than the first side 103*b*.

Accordingly, when the first and second contact modules 55*a* and 55*b* are disposed adjacent each other such that the second side 105*a* faces the first side 103*b* as illustrated in FIG. 9B with respect to the first and second contact modules 120*a* and 120*b*, the intermediate portions 49*b* and 49*a* of the first and second contact modules 120*a* and 120*b*, respectively, are spaced more closely than the intermediate portions 49*a* and 49*b* of the first and second contact modules 120*a* and 120*b*, respectively. The adjacent first and second pluralities of electrical contacts 46*a* and 46*b* of the first and second contact modules 120*a* and 120*b* along the common row direction 39, respectively, define ground contacts G. The adjacent second and first pluralities of electrical contacts 46*b* and 46*a* of the first and second contact modules 120*a* and 120*b* along the common row direction 39, respectively define signal contacts S. The adjacent signal contacts S along the common row direction 39 define differential signal pairs 122. Thus, it should be appreciated that the intermediate portions 49*b* and 49*a* of each differential pair 122 of adjacent signal contacts 46*b* and 46*a* of the first and second contact modules 120*a* and 120*b*, respectively, are spaced more closely than the intermediate portions 49*a* and 49*b* of each pair of adjacent ground contacts 46*a* and 46*b* of the first and second contact modules 120 and 120*b*, respectively. Alternatively, the signal contacts S could be provided as single-ended signal contacts.

None of the signal contacts S of the differential signal pairs 122 in the first contact configuration 124 is disposed immediately adjacent another signal contact. Rather, a ground contact G is disposed immediately adjacent the signal contacts S of each differential pair 122. For instance, a ground contact G can be disposed on both sides of the differential pair 122 in the respective row, and a ground contact G can be disposed on both sides of each signal contact C of the differential pair 122 in their respective columns 57. Thus, it can be said that the signal contacts S of a given differential pair 122 are surrounded by ground contacts G, thereby providing reduced crosstalk during operation. Furthermore, because the intermediate portions of adjacent signal contacts S that define a given differential signal pairs 122 are offset closer together than the adjacent ground contacts, the pluralities of differential signal pairs 122 are also spaced further apart from each other, thereby reducing cross-talk during operation. The first electrical connector 122 can provide improve electromagnetic field coupling between the signal contacts S that define a differential signal pair 122, such that the first electrical connector 22 can be devoid of shields and operate at 10 Gigabits/second with 6% or less of asynchronous, worst-case, multi-active cross-talk.

Furthermore, when the second and first contact modules 55*b* and 55*a* are disposed adjacent each other such that the second side 105*b* faces the first side 103*a* as illustrated in FIG. 9B with respect to the third and fourth contact modules 120*c* and 120*d*, the intermediate portions 49*b* and 49*a* of the third and fourth contact modules 120*c* and 120*c*, respectively, are spaced more closely than the intermediate portions 49*a* and 49*b* of the third and fourth contact modules 120*c* and 120*d*, respectively. The adjacent first and second pluralities of electrical contacts 46*a* and 46*b* of the third and fourth contact modules 120*a* and 120*b* along the common row direction 39, respectively, define ground contacts G. The adjacent second and first pluralities of electrical contacts 46*b* and 46*a* of the third and fourth contact modules 120*a* and 120*b* along the common row direction 39, respectively define signal contacts S. The adjacent signal contacts S along the common row direction 39 define differential signal pairs 122. Thus, it should be appreciated that the intermediate portions 49*b* and 49*a* of each differential pair 122 of adjacent signal contacts 46*b* and 46*a* of the third contact modules 120*a* and 120*b*, respectively, are spaced more closely than the intermediate portions 49*a* and 49*b* of each pair of adjacent ground contacts 46*a* and 46*b* of the third and fourth contact modules 120 and 120*b*, respectively.

It should be appreciated that each of the four contact modules 120*a*-120*d* has a different contact configuration than each of the other of the four contact modules 120*a*-and 120*d*. The different contact configuration can be at least one of 1) a different assignment the signal and ground contacts with respect to a common column direction along the respective columns of each contact module, and 2) a placement of the electrical contacts in the contact modules.

For instance, the first contact module 120*a* is illustrated as the first contact module 55*a*, while the second and third contact modules 120*b* and 120*c* are each illustrated as the second contact module 55*b*. Thus, the row location of the first plurality of electrical contacts 46*a* of the first contact module 120*a* is different than the row location of the first plurality of electrical contacts 46*a* of the second and third contact modules 120*b* and 120*c* along their respective columns in the common column direction 53. Likewise, the row location of the second plurality of electrical contacts 46*b* of the first contact module 120*a* is different than the location of the second plurality of electrical contacts 46*b* of the second and third contact modules 120*b* and 120*c* along their respective columns in the common column direction 53.

Additionally, the first contact module 120*a* has a different assignment of the signal and ground contacts with respect to the column direction 53 along the column 47*a* than the fourth contact module 120*d* along the column 47*d*. In particular, while the first and fourth contact modules 120*a* and 120*d* are both illustrated as first contact modules 55*a* (and thus have the same placement of electrical contacts in the respective contact modules along the column direction), the first plurality of electrical contacts 46*a* of the first contact module 120*a* are ground contacts G, while the first plurality of electrical contacts 46*a* of the fourth contact module 120*d* are signal contacts S. Likewise, each of the second plurality of electrical contacts 46*b* of the first contact module 120*a* is a signal contact S, while each of the second plurality of electrical contacts 46*b* of the fourth contact module 120*d* are is a ground contact G.

Because the signal contacts S of each differential signal pair 122 are disposed in different columns 53 and are disposed adjacent each other along the common row direction 39, the broadsides 104 of the signal contacts S face each other (see FIGS. 3B and 6B). Thus, it can be said that each of the differential signal pairs 122 is a broadside coupled differential signal pair.

It is further appreciated that the first contact configuration 124 provides a first contact module 120*a*, a second contact module 120*b* disposed immediately adjacent the first contact module 120*a* along the common row direction 39, and a third contact module 120*c* disposed immediately adjacent the second contact module 120*b* along the row direction 39 such that the second contact module 120*b* is disposed between the first and the third contact modules 120*a* and 120*c*, respectively. Each of the first, second, and third contact modules 120*a-c*, respectively include a plurality of electrical contacts 46 spaced along respective columns 47*a-c*. At least one of the electrical contacts 46 of each of the contact modules 120*a-c* is a signal contact S, and at least one of the electrical contacts 46 of each of the contact modules 120*a-c* is a signal contact G. The electrical contacts 46*a* and 46*b* of the first contact module 120*a* are arranged in a first pattern along the common column direction 53, as described above with respect to the contact module 55*a*. The electrical contacts 46*a* and 46*b* of the second contact module 120*b* are arranged in a second pattern that is different than the first pattern along the column direction, and the electrical contacts of the third contact module 120*c* are arranged in a second pattern. The first contact configuration 124 further includes a fourth contact module 120*d* disposed immediately adjacent the third contact module 120*c* such that the third contact module 120*c* is disposed between the second contact module 120*b* and the fourth contact module 120*d*. The fourth contact module 120*d* including a plurality of electrical contacts 46 spaced along the column 47*d*. At least one of the electrical contacts 46 of the fourth contact module 120*d* is a signal contact S, and at least one of the electrical contacts 46 of the fourth contact module 120*d* is a ground contact G. The electrical contacts 46 of the fourth contact module 120 are arranged in the first pattern along the column direction 53.

Figure 10B:
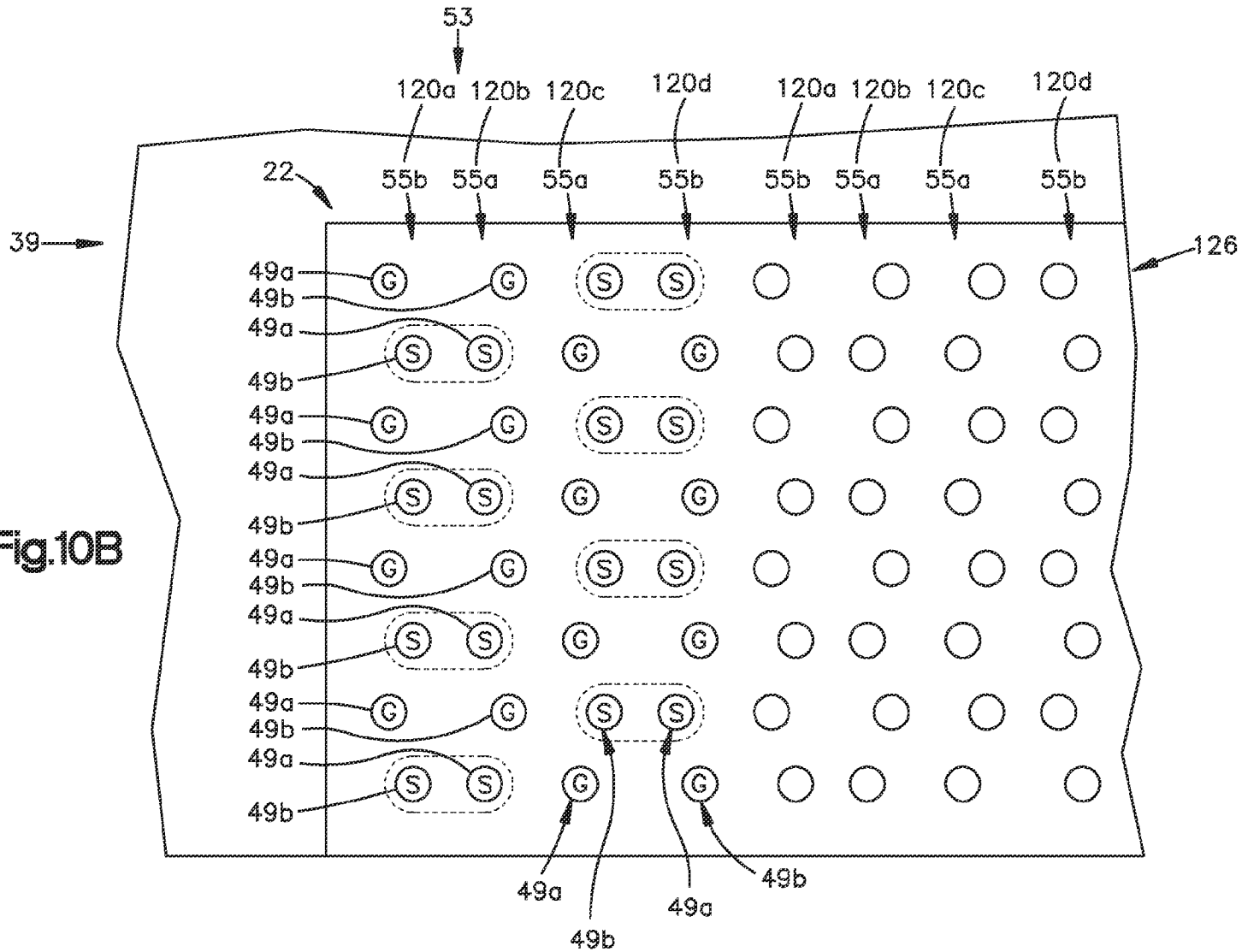
FIG. 10B is a schematic view of the first and second pluralities of electrical contacts of the contact modules illustrated in FIG. 10A.

Referring now to FIGS. 10A-B in particular, the electrical connector 22 is arranged in a second contact configuration 126 of immediately adjacent contact modules in a repeating 55*b*-55*a*-55*a*-55*b* configuration, such that no contact modules are disposed between the immediately adjacent contact modules. Thus, it should be appreciated that the second contact configuration 126 is different than the first contact configuration 124. In particular, the second contact configuration 126 is the inverse of the first contact configuration 124, whereby the first contact modules 55*a* of the first contact configuration 124 are replaced by second contact modules 55*b* in the second contact configuration 126, and the second contact modules 55*b* of the first contact configuration 124 are replaced by the first contact modules 55*a* in the second contact configuration 126. As illustrated, the second contact module 55*b* is disposed in columns 47*a*, 47*d*, 47*e*, and 47*h*, and the first contact module 55*a* is disposed in columns 47*b*, 47*c*, 47*f*, and 47*g*. Thus, in accordance with the embodiment illustrated in FIGS. 10A-B, the electrical connector includes a first contact module 120*a* provided as the second contact module 55*b*, a second contact module 120*b* provided as the first contact module 55*a*, a third contact module 120*c* provided as the first contact module 55*a*, and a fourth contact module 120*d* provided as the second contact module 55*b*.

Referring now to FIGS. 2A-B, 5A-B, and 10A-B, in the second contact configuration 126, the first and contact modules 120*a* and 120*b* are provided such that the second side 105*b* of the second contact module 55*b* (see FIG. 5A) is disposed adjacent the first side 103*a* of the first contact module 55*a* (see FIG. 2A). Thus, the outer side 101*d* of the fourth leadframe assembly 57*b* is disposed adjacent the outer side 101*a* of the first leadframe assembly 57*a*. Each of the first plurality of electrical contacts 49*a* of the second contact module 55*b* is disposed in the same row as each of the second plurality of electrical contacts 49*b* of the first contact module 55*a*. Likewise, each of the second plurality of electrical contacts 49*b* of the second contact module 55*b* is disposed in the same row as each of the first plurality of electrical contacts 49*a* of the second contact module 55*a*.

The intermediate portions 49*b* of the second plurality of electrical contacts 46*b* of the second contact module 55*b* are disposed closer to the second side 105*b* than the first side 103*b*. The intermediate portions 49*a* of the first plurality of electrical contacts 46*a* of the first contact module 55*a* are disposed closer to the first side 103*a* than the second side 105*a*. The intermediate portions 49*a* of the second contact module 55*b* are disposed closer to the first side 103*b* than the second side 105*b*. The intermediate portions 49*b* of the first contact module 55*a* are disposed closer to the second side 105*a* than the first side 103*a*.

Accordingly, when the second and first contact modules 55*b* and 55*a* are disposed adjacent each other such that the second side 105*b* faces the first side 103*a* as illustrated in FIG. 10B with respect to the first and second contact modules 120*a* and 120*b*, the intermediate portions 49*b* and 49*a* of the first and second contact modules 120*a* and 120*b*, respectively, are spaced more closely than the intermediate portions 49*a* and 49*b* of the first and second contact modules 120*a* and 120*b*, respectively. The adjacent first and second pluralities of electrical contacts 46*a* and 46*b* of the first and second contact modules 120*a* and 120*b* along the common row direction 39, respectively, define ground contacts G. The adjacent second and first pluralities of electrical contacts 46*b* and 46*a* of the first and second contact modules 120*a* and 120*b* along the common row direction 39, respectively define signal contacts S. The adjacent signal contacts S along the common row direction 39 define differential signal pairs 122. Thus, it should be appreciated that the intermediate portions 49*b* and 49*a* of each differential pair 122 of adjacent signal contacts 46*b* and 46*a* of the first and second contact modules 120*a* and 120*b*, respectively, are spaced more closely than the intermediate portions 49*a* and 49*b* of each pair of adjacent ground contacts 46*a* and 46*b* of the first and second contact modules 120 and 120*b*, respectively. Alternatively, the signal contacts S could be provided as single-ended signal contacts.

None of the signal contacts S of the differential signal pairs 122 in the second contact configuration 126 is disposed immediately adjacent another signal contact. Rather, a ground contact G is disposed immediately adjacent the signal contacts S of each differential pair 122. For instance, a ground contact G can be disposed on both sides of the differential pair 122 in the respective row, and a ground contact G can be disposed on both sides of each signal contact C of the differential pair 122 in their respective columns 57. Thus, it can be said that the signal contacts S of a given differential pair 122 are surrounded by ground contacts G, thereby providing reduced cross-talk during operation.

Furthermore, when the first and second contact modules 55*a* and 55*b* are disposed adjacent each other such that the second side 105*a* faces the first side 103*b* as illustrated in FIG. 10B with respect to the third and fourth contact modules 120*c* and 120*d*, the intermediate portions 49*b* and 49*a* of the third and fourth contact modules 120*c* and 120*c*, respectively, are spaced more closely than the intermediate portions 49*a* and 49*b* of the third and fourth contact modules 120*c* and 120*d*, respectively. The adjacent first and second pluralities of electrical contacts 46*a* and 46*b* of the third and fourth contact modules 120*a* and 120*b* along the common row direction 39, respectively, define ground contacts G. The adjacent second and first pluralities of electrical contacts 46*b* and 46*a* of the third and fourth contact modules 120*a* and 120*b* along the common row direction 39, respectively define signal contacts S. The adjacent signal contacts S along the common row direction 39 define differential signal pairs 122. Thus, it should be appreciated that the intermediate portions 49*b* and 49*a* of each differential pair 122 of adjacent signal contacts 46*b* and 46*a* of the third contact modules 120*a* and 120*b*, respectively, are spaced more closely than the intermediate portions 49*a* and 49*b* of each pair of adjacent ground contacts 46*a* and 46*b* of the third and fourth contact modules 120 and 120*b*, respectively.

It should be appreciated that each of the four contact modules 120*a*-120*d* has a different contact configuration than each of the other of the four contact modules 120*a*- and 120*d*. The different contact configuration can be at least one of 1) a different assignment the signal and ground contacts with respect to a common column direction along the respective columns of each contact module, and 2) a placement of the electrical contacts in the contact modules.

For instance, the first contact module 120*a* is illustrated as the first contact module 55*b*, while the second and third contact modules 120*b* and 120*c* are each illustrated as the first contact module 55*a*. Thus, the row location of the first plurality of electrical contacts 46*a* of the first contact module 120*a* is different than the row location of the first plurality of electrical contacts 46*a* of the second and third contact modules 120*b* and 120*c* along their respective columns in the common column direction 53. Likewise, the row location of the second plurality of electrical contacts 46*b* of the first contact module 120*a* is different than the row location of the second plurality of electrical contacts 46*b* of the second and third contact modules 120*b* and 120*c* along their respective columns in the common column direction 53.

Additionally, the first contact module 120*a* has a different assignment of the signal and ground contacts with respect to the column direction 53 along the column 47*a* than the fourth contact module 120*d* along the column 47*d*. In particular, while the first and fourth contact modules 120*a* and 120*d* are both illustrated as second contact modules 55*b* (and thus have the same placement of electrical contacts in the respective contact modules along the column direction), each of the first plurality of electrical contacts 46*a* of the first contact module 120*a* is a ground contact G, while each of the first plurality of electrical contacts 46*a* of the fourth contact module 120*d* is a signal contact S. Likewise, each of the second plurality of electrical contacts 46*b* of the first contact module 120*a* is a signal contact S, while each of the second plurality of electrical contacts 46*b* of the fourth contact module 120*d* are is a ground contact G.

Because in FIG. 10B the signal contacts S of each differential signal pair 122 are disposed in different columns 53 and are disposed adjacent each other along the common row direction 39, the broadsides 104 of the signal contacts S face each other (see FIGS. 3B and 6B). Thus, it can be said that each of the differential signal pairs 122 is a broadside coupled differential signal pair.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector comprising: a first contact module and a second contact module adjacent the first contact module, each contact module having a plurality of first and second electrical contacts, each of the first and second electrical contacts including a mating portion, a mounting portion, and an intermediate portion extending between the mating portion and the mounting portion, such that in each contact module, the intermediate portions of the first electrical contacts are disposed in a first common plane and the intermediate portions of the second electrical contacts are disposed in a second common plane that is spaced from the first common plane, wherein the first contact modules and the second contact modules are arranged such that two adjacent ones of the second electrical contacts of the first and second contact modules, respectively, are spaced more closely than the intermediate portions of two adjacent ones of the first electrical contacts of the first and second contact modules, respectively, wherein the first electrical contacts are ground contacts and the second electrical contacts are signal contacts, and the two adjacent ones of the signal contacts define a differential signal pair.

2. The electrical connector as recited in claim 1, wherein the signal contacts and the ground contacts are arranged in each contact module in an alternating pattern along a column direction.

3. The electrical connector as recited in claim 1, wherein the mounting portions of the signal contacts are offset with respect to the intermediate portions of the signal contacts, and the mounting portions of the ground contacts are offset with respect to the intermediate portions of the ground contacts.

4. The electrical connector as recited in claim 1, wherein the intermediate portions of the signal contacts are coplanar with the mounting portions of the signal contacts, and the intermediate portions of the ground contacts are coplanar with the mounting portions of the ground contacts.

5. The electrical connector as recited in claim 1, wherein the mating portions of the signal contacts and ground contacts are offset with respect to the intermediate portions of the signal and ground contacts, respectively.

6. The electrical connector as recited in claim 1, wherein the electrical connector comprises a receptacle connector having a housing that retains the first and second contact modules, the housing defines a plurality of aligned receptacle pockets that are also aligned with the mating portions of the ground contacts and the signal contacts such that the receptacle pockets are configured to receive corresponding header contacts that mate with the mating portions of the ground and signal contacts.

7. An electrical connector comprising: a connector housing defining a plurality of receptacle pockets; a first leadframe assembly retained by the connector housing and a second leadframe assembly carried by the connector housing at a location adjacent the first leadframe assembly, the first leadframe assembly including a first leadframe housing and a plurality of signal contacts retained by the first leadframe housing, the second leadframe assembly including a second leadframe housing and a plurality of ground contacts retained by the second leadframe housing, such that the signal and ground contacts are arranged in an alternating pattern along a column direction, each signal and ground contact including a mating portion, a mounting portion, and an intermediate portion extending between the mating portion and the mounting portion, wherein the intermediate portions of the ground contacts are disposed in a first common plane and the intermediate portions of the signal contacts are disposed in a second common plane that is spaced from the first common plane, the mating portions of the ground contacts are offset with respect to the first common plane in a direction toward the second common plane, the mating portions of the signal contacts are offset with respect to the second common plane in a direction toward the first common plane, and each receptacle pocket is aligned with a select one of the mating portions of the signal contacts and the mating portions of the ground contacts.

8. The electrical connector as recited in claim 7, wherein the electrical connector comprises a receptacle connector having aligned receptacle pockets configured to receive respective header contacts of a complementary header connector that mate with the mating portions of the signal and ground contacts, wherein the receptacle pockets are aligned with the mating portions of the signal contacts and ground contacts.

9. An electrical connector comprising: a first contact module, a second contact module disposed immediately adjacent the first contact module along a row direction, and a third contact module disposed immediately adjacent the second contact module along the row direction such that the second contact module is disposed between the first and the third contact modules, each of the first, second, and third contact modules including a plurality of electrical contacts spaced along respective columns, at least one of which is a signal contact and at least one of which is a ground contact; wherein the electrical contacts of the first contact module are arranged in a first pattern along a column direction, the electrical contacts of the second contact module are arranged in a second pattern that is different than the first pattern along the column direction, and the electrical contacts of the third contact module are arranged in the second pattern.

10. The electrical connector as recited in claim 9, wherein the signal contact of the second contact module and the signal contact of the third contact module define a differential signal pair.

11. The electrical connector as recited in claim 9, further comprising a fourth contact module disposed immediately adjacent the third contact module such that the third contact module is disposed between the second contact module and the fourth contact module, the fourth contact module including a plurality of electrical contacts spaced along a respective column, at least one of which is a signal contact and at least one of which is a ground contact, wherein the electrical contacts of the fourth contact module are arranged in the first pattern along the column direction.

12. The electrical connector as recited in claim 9, wherein the ground contacts and signal contacts are disposed at respective first locations in the first pattern, and the ground contacts and signal contacts are disposed at respective second locations in the second pattern, wherein the second locations are different than the first locations.

13. An electrical connector comprising: a connector housing; a first contact module, a second contact module, a third contact module, and a fourth contact module, each contact module including a contact module housing and a plurality of electrical contacts including a plurality of ground contacts and a plurality of signal contacts, wherein each contact module has a different contact configuration than each of the other contact modules.

14. The electrical connector as recited in claim 13, wherein the electrical contacts of each contact module are spaced along a respective column, and the contact configuration comprises at least one of 1) a different assignment the signal and ground contacts with respect to a common column direction along the respective columns of each contact module, and 2) a placement of the electrical contacts in the contact modules.

* * * * *